US008033963B1

(12) United States Patent
Jones

(10) Patent No.: US 8,033,963 B1
(45) Date of Patent: Oct. 11, 2011

(54) EXERCISE AND WORKOUT APPARATUS WITH KARATE ELEMENTS

(76) Inventor: Tom Jones, Huntington Beach, CA (US)

( * ) Notice: Subject to any disclaimer, the term of this patent is extended or adjusted under 35 U.S.C. 154(b) by 703 days.

(21) Appl. No.: 11/401,068

(22) Filed: Apr. 10, 2006

(51) Int. Cl.
*A63B 69/20* (2006.01)
*A63B 21/062* (2006.01)
*A63B 23/035* (2006.01)

(52) U.S. Cl. ..... 482/87; 482/100; 482/102; 482/138

(58) Field of Classification Search ..... 482/83, 482/84, 86–90, 92–94, 98–102, 136–138
See application file for complete search history.

(56) References Cited

U.S. PATENT DOCUMENTS

| | | | | |
|---|---|---|---|---|
| 5,152,733 | A * | 10/1992 | Farenholtz et al. | 482/135 |
| 5,503,606 | A * | 4/1996 | Stephens | 482/7 |
| 5,554,088 | A * | 9/1996 | Zlojutro | 482/83 |
| 6,220,992 | B1 * | 4/2001 | Shafik | 482/83 |
| 6,348,028 | B1 * | 2/2002 | Cragg | 482/148 |
| 6,416,445 | B1 * | 7/2002 | Nelson et al. | 482/83 |
| 7,329,210 | B1 * | 2/2008 | Marano | 482/83 |
| 2002/0022556 | A1 * | 2/2002 | Eriksson et al. | 482/92 |
| 2005/0209066 | A1 * | 9/2005 | Penney | 482/84 |

FOREIGN PATENT DOCUMENTS

| | | | |
|---|---|---|---|
| DE | 3139921 | A1 * | 4/1983 |
| EP | 557264 | A2 * | 8/1993 |
| EP | 2228104 | A1 * | 9/2010 |
| FR | 2630652 | A1 * | 11/1989 |
| JP | 06178834 | A * | 6/1994 |

* cited by examiner

*Primary Examiner* — LoAn H. Thanh
*Assistant Examiner* — Victor K Hwang

(57) ABSTRACT

The present invention may be used for human exercise. The apparatus for human exercise may have a support frame having two interior frame members spaced apart and positioned generally vertical with two side frame members spaced apart from and generally parallel to the two interior frame members. An upper cross member may be attached at an upper end and a lower cross member may be attached at a lower end of the two interior frame members and the two side frame members. A right kick arm element and a left kick arm element may be rotatably attached to the support frame and a kick board may be attached to the two interior frame members.

24 Claims, 23 Drawing Sheets

EXERCISE AND WORKOUT APPARATUS WITH KARATE ELEMENTS

BACKGROUND OF THE INVENTION

The invention relates to apparatus for use in exercising and strengthening the human body. The new apparatus allows exercising many elements of the human body and exercising martial arts methods. Various exercise devices or apparatus may be attached to allow a broad range of exercise methodology.

There may currently exist apparatus for exercising the human body. These apparatus may allow combinations of weight exercise for arms, legs, body twisting and bending as well as other body strengthening and toning. The structure used to create the force or weight resistance for exercising may not allow for an ease of selection and operation of the apparatus. Also, many exercise apparatus do not allow attachment of a selection of different types of exercise devices. The incorporation of martial arts devices to allow such exercising may not be compatible with more traditional weight exercise apparatus.

SUMMARY OF THE INVENTION

The present invention is directed to apparatus for human exercise. An apparatus for human exercise may have a support frame having two interior frame members spaced apart and positioned generally vertical with two side frame members spaced apart from and generally parallel to the two interior frame members. An upper cross member may be attached at an upper end and a lower cross member may be attached at a lower end of the two interior frame members and the two side frame members. A right kick arm element and a left kick arm element may be rotatably attached to the support frame and a kick board may be attached to the two interior frame members.

A central vertical structure may have an upper frame element and a lower frame element with four upright frame members attached therebetween to form a generally open rectangular box frame. An upper pulley assembly may be attached to an upper portion of the central vertical structure and a lower pulley assembly may be attached to a lower portion of the central vertical structure. A weight apparatus may have a plurality of weight elements disposed in the central vertical structure. A weight select rod may be disposed centrally in each of the weight elements that may have weight apertures therein and each weight element may have a select rod attachment element for attachment to said weight select rod. A first cable may be attached to the weight select rod and routed over a first pulley in the upper pulley assembly to be attached to a weight select element wherein the weight select element may be movable vertically in the central vertical structure. A second cable may be attached to the upper frame element by a first tension spring and extended downwardly to be routed over a second pulley and a third pulley in the lower pulley assembly, and then extended upwardly to be routed over a fourth pulley rotatably attached to an elevated attachment shaft wherein the second cable releasably attachable to the weight select element. A third cable and a fourth cable may each be attached to the upper frame element by a tension spring and may extend downwardly, the third cable may be routed over a fifth pulley in the lower pulley assembly and may be attached to a sixth pulley, and the fourth cable may be routed over a seventh pulley in the lower pulley assembly and may be attached to an eighth pulley wherein the third cable and the fourth cable may be releasably attachable to the weight select element. The sixth pulley and the eighth pulley may be fixedly attached to a press shaft rotatably attached to the central vertical structure intermediate the upper portion and the lower portion and the press shaft may have a press bar attached at each end. A fifth cable and a sixth cable may each be attached to the upper frame element by a tension spring and may extend downwardly, the fifth cable may be routed over a ninth and a tenth pulley in the lower cable assembly to then extend upwardly and be routed over an eleventh pulley to be attached to a twelfth pulley, and the sixth cable may be routed over a thirteenth and a fourteenth pulley in the lower pulley assembly to then extend upwardly and be routed over a fifteenth pulley to be attached to a sixteenth pulley wherein the fifth cable and the sixth cable may be releasably attachable to the weight select element. The twelfth pulley and the sixteenth pulley may each be attached in a pivot assembly wherein each of the pivot assemblies may be attached to a support plate disposed and attached to the central vertical structure intermediate the upper portion and the lower portion. Each of the pivot assemblies may have a pec element attached.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
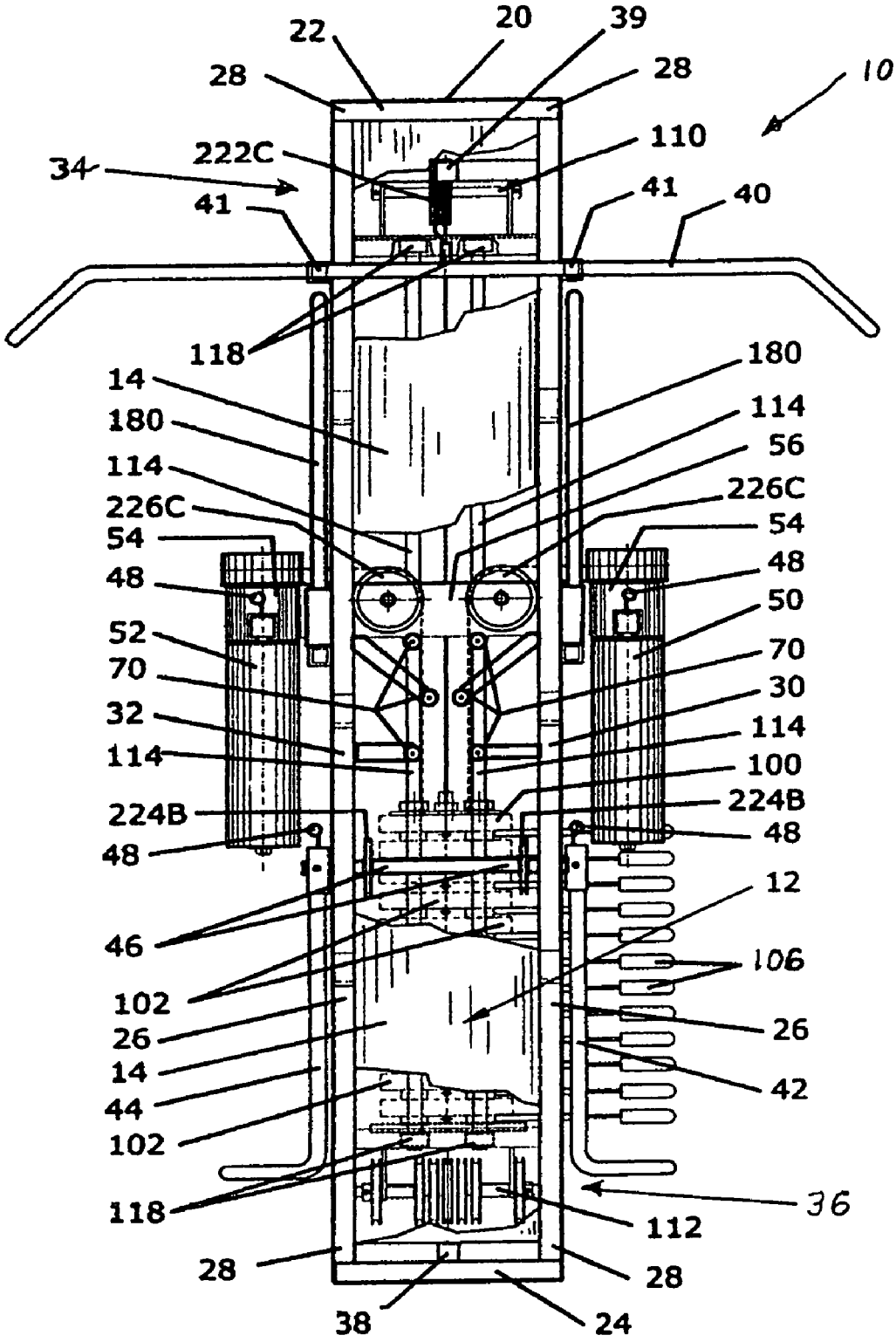
FIG. 1 illustrates a front elevation view of the apparatus according to an embodiment of the invention.
Figure 2:
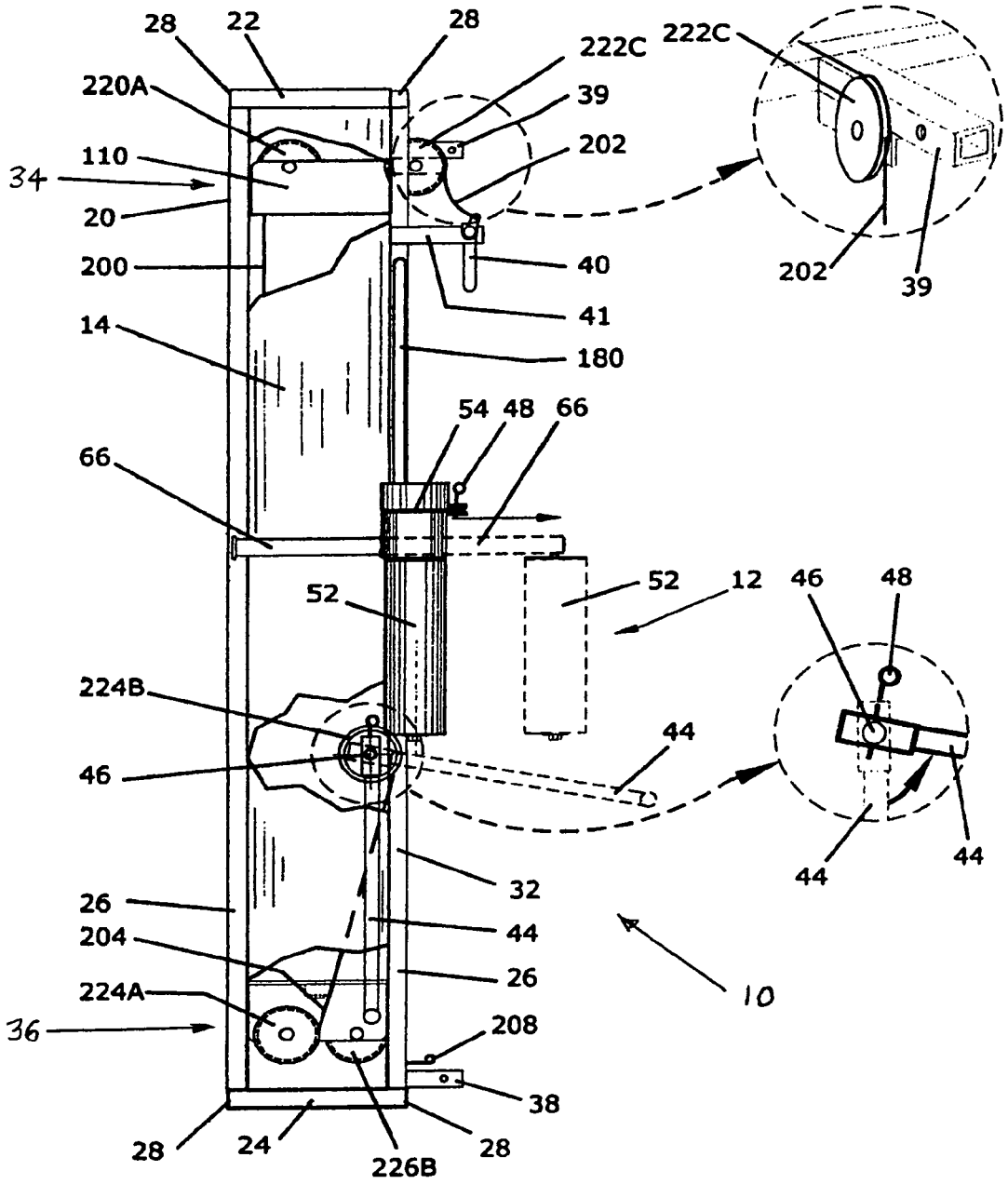
FIG. 2 illustrates a side elevation view of the apparatus according to an embodiment of the invention.
Figure 3:
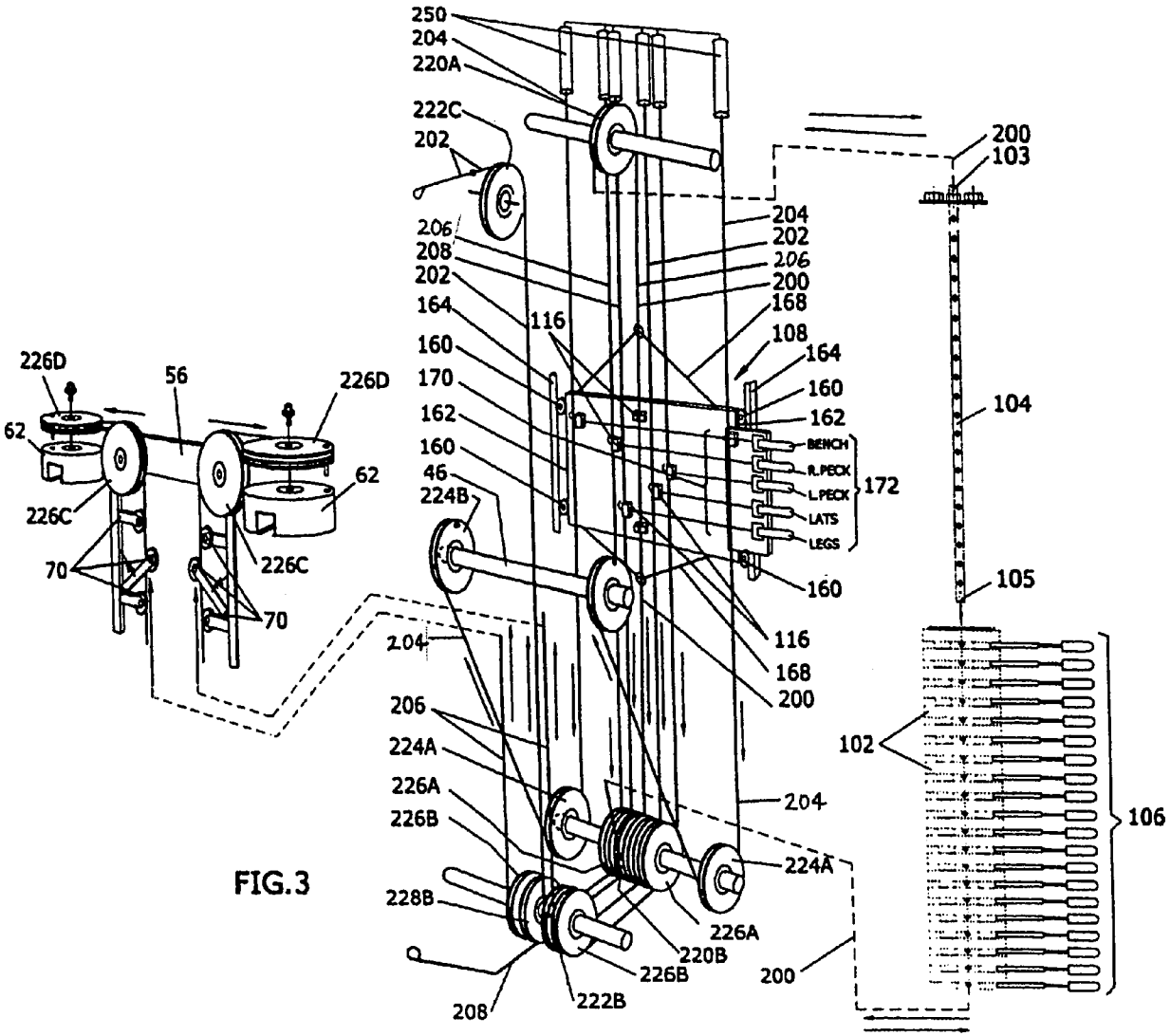
FIG. 3 illustrates a perspective elevation view of a cable and pulley system according to an embodiment of the invention.
Figure 4:
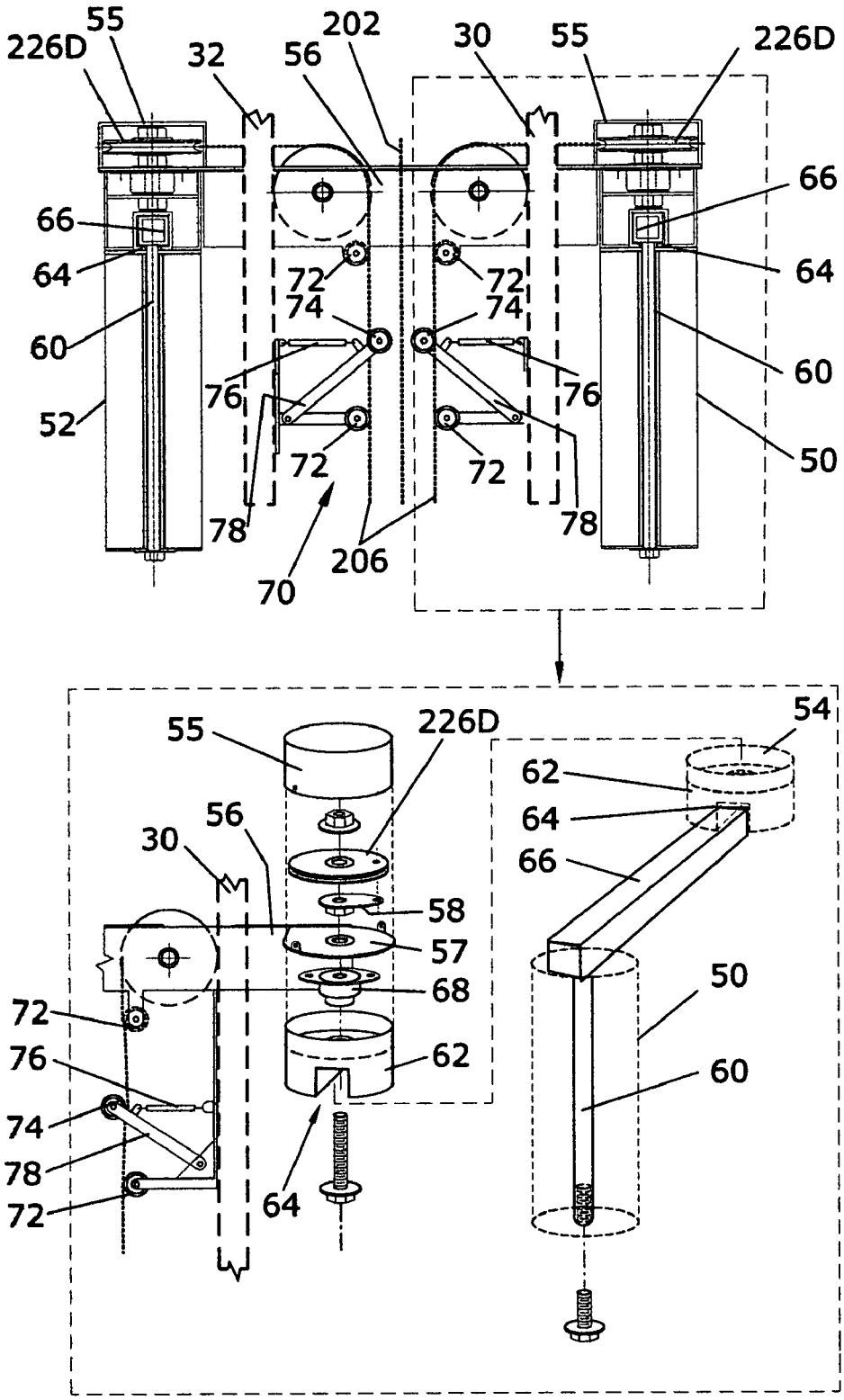
FIG. 4 illustrates a front elevation cross sectional view of a pec arm element pulley apparatus according to an embodiment of the invention.
Figure 5B:
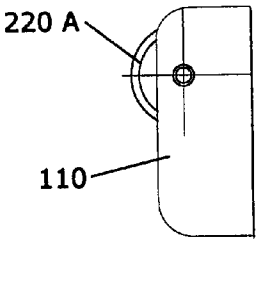
FIG. 5B illustrates a right side view of an upper pulley assembly according to an embodiment of the invention.
Figure 5:
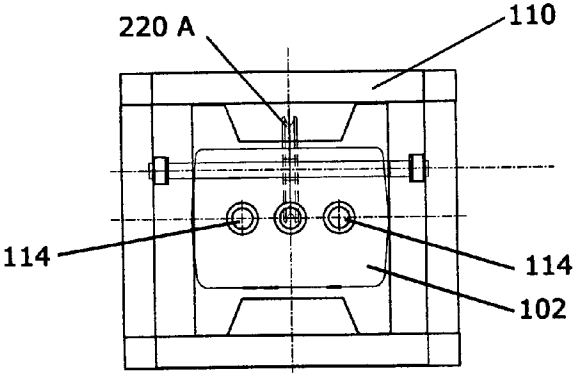
FIG. 5 illustrates a bottom view of an upper pulley assembly according to an embodiment of the invention.
Figure 5A:
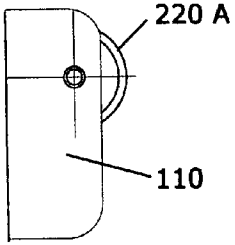
FIG. 5A illustrates a left side view of an upper pulley assembly according to an embodiment of the invention.
Figure 6B:
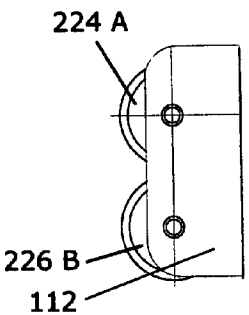
FIG. 6B illustrates a right side view of a lower pulley assembly according to an embodiment of the invention.
Figure 6:
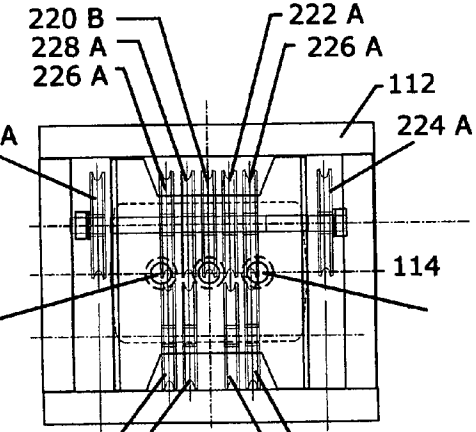
FIG. 6 illustrates a top view of a lower pulley assembly according to an embodiment of the invention.
Figure 6A:
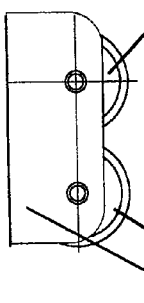
FIG. 6A illustrates a left side view of a lower pulley assembly according to an embodiment of the invention.
Figure 7:
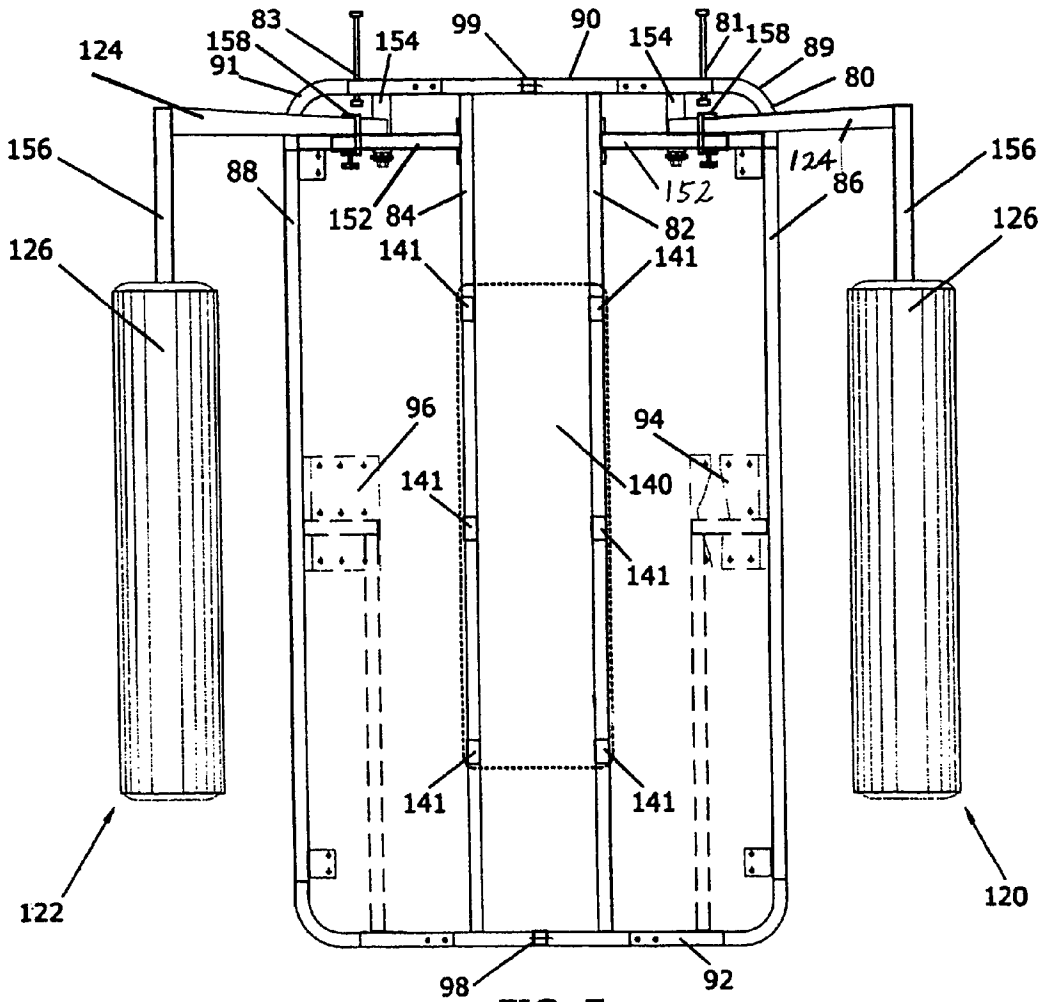
FIG. 7 illustrates a front elevation view of a support frame according to an embodiment of the invention.
Figure 8:
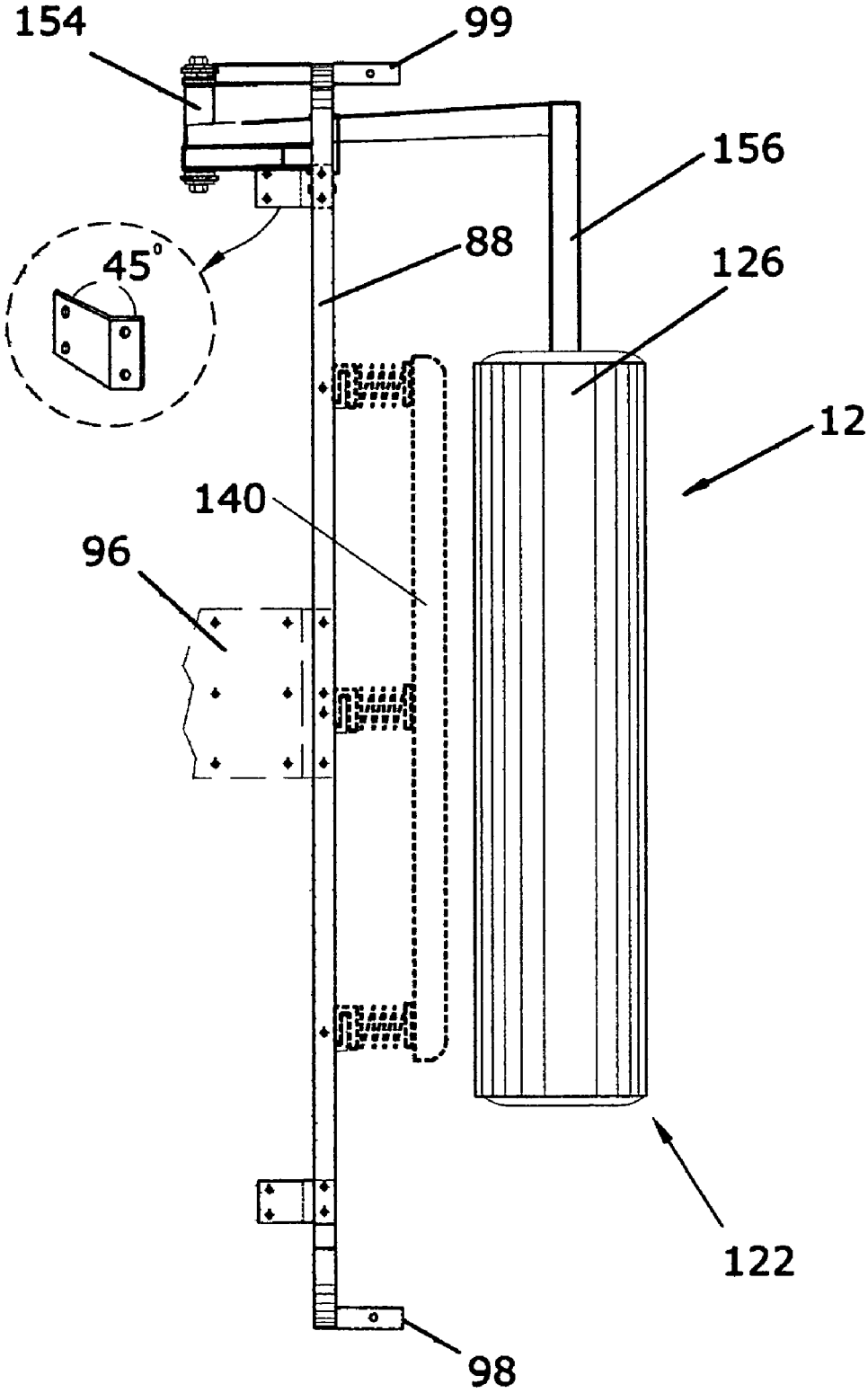
FIG. 8 illustrates a side elevation view of the support frame according to an embodiment of the invention.
Figure 9:
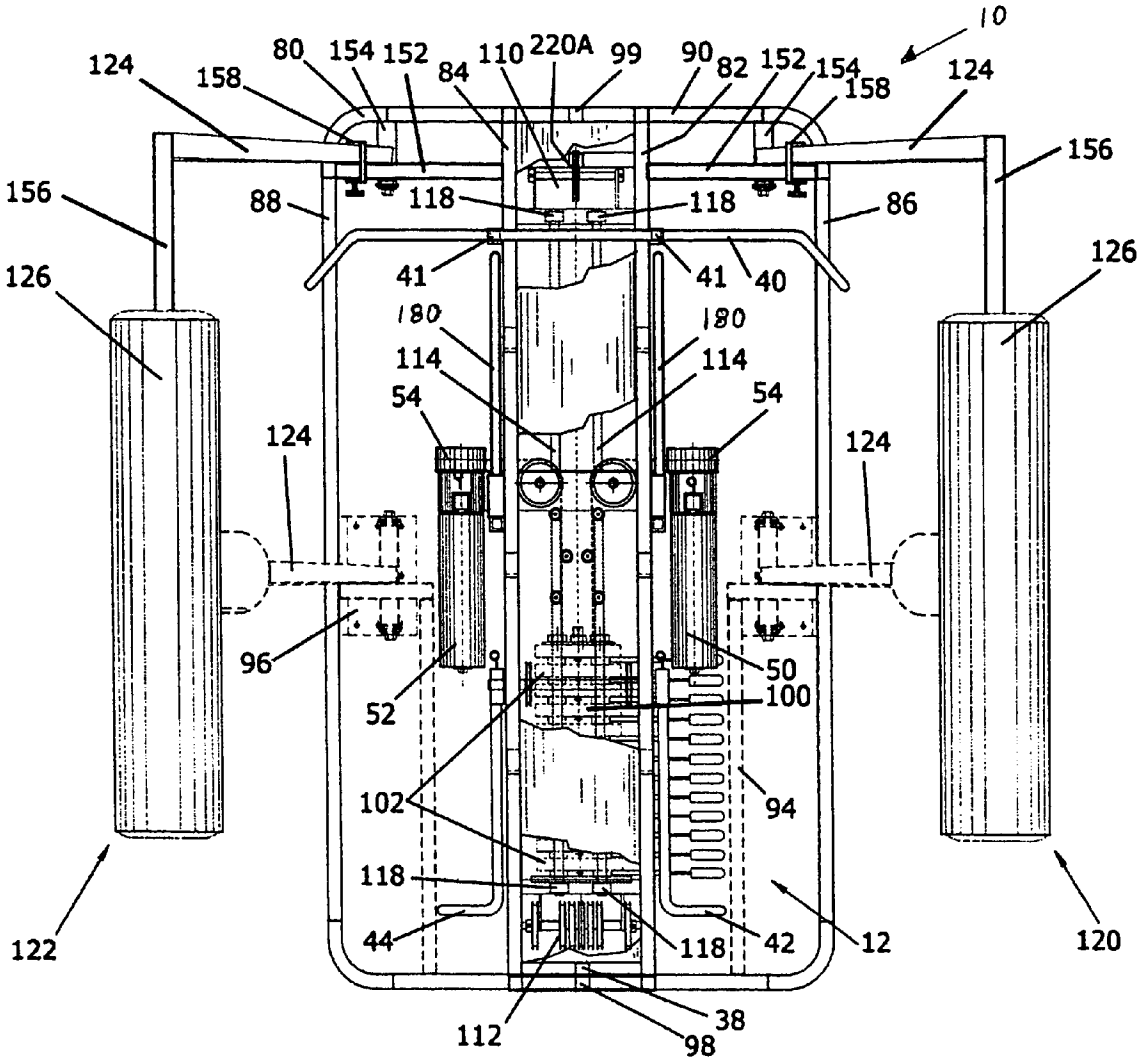
FIG. 9 illustrates a front elevation view of an augmented embodiment of the apparatus according to an embodiment of the invention.
Figure 10:
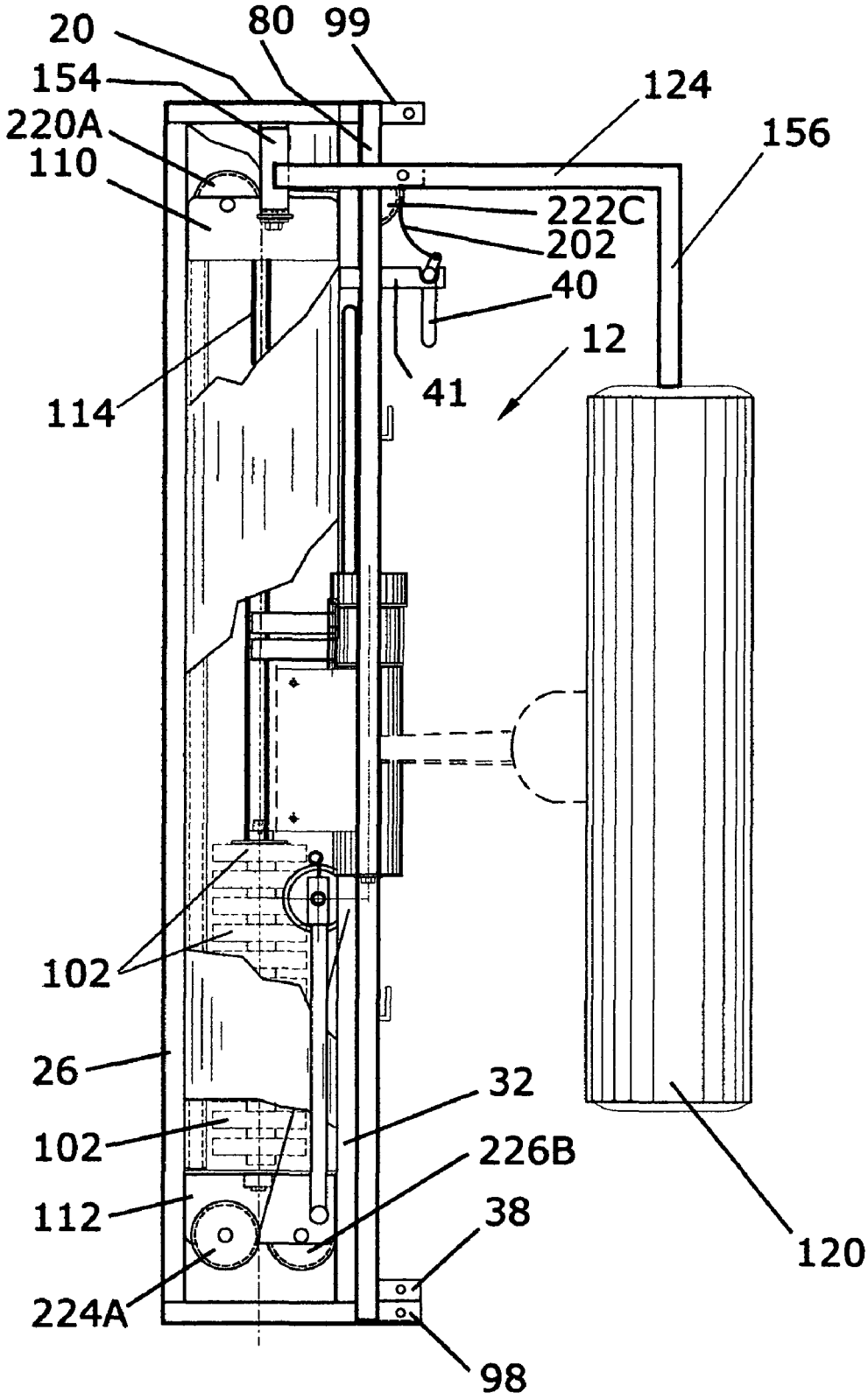
FIG. 10 illustrates a side elevation view of the augmented embodiment of the apparatus according to an embodiment of the invention.
Figure 12:
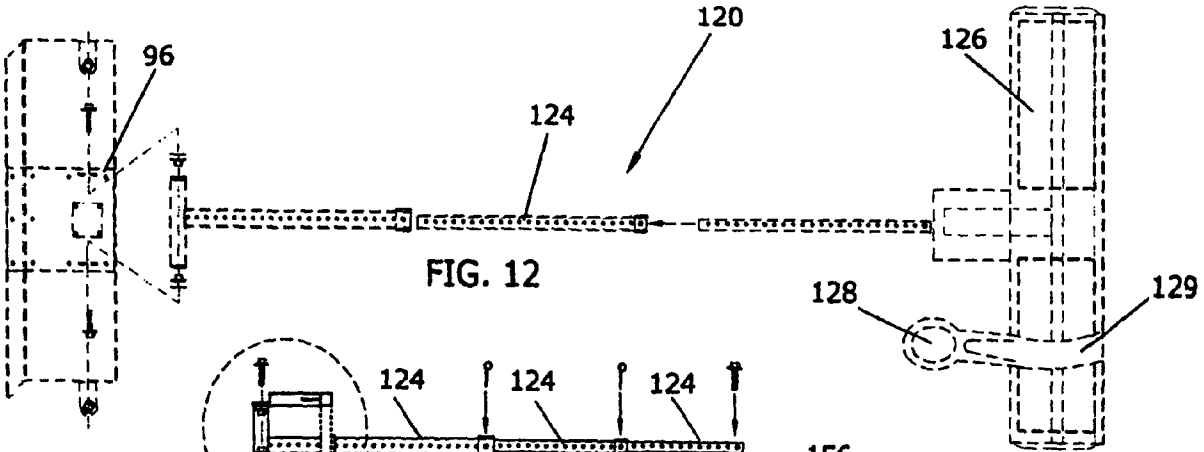
FIG. 12 illustrates an exploded elevation view of a kick arm element according to an embodiment of the invention.
Figure 11:
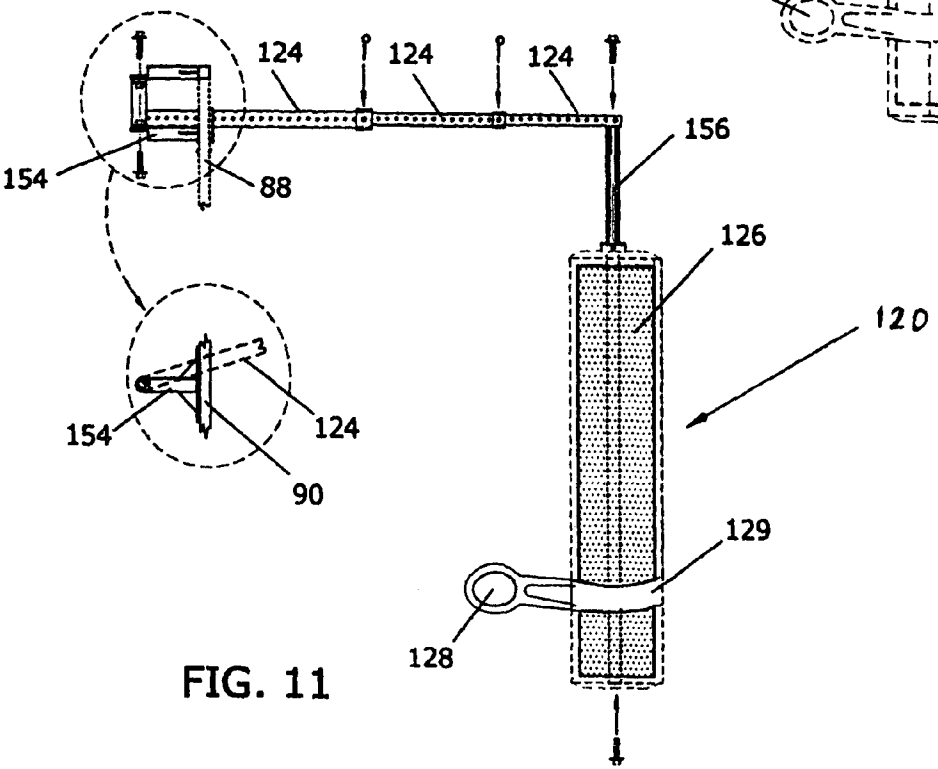
FIG. 11 illustrates an elevation view of a kick arm element according to an embodiment of the invention.
Figure 13:
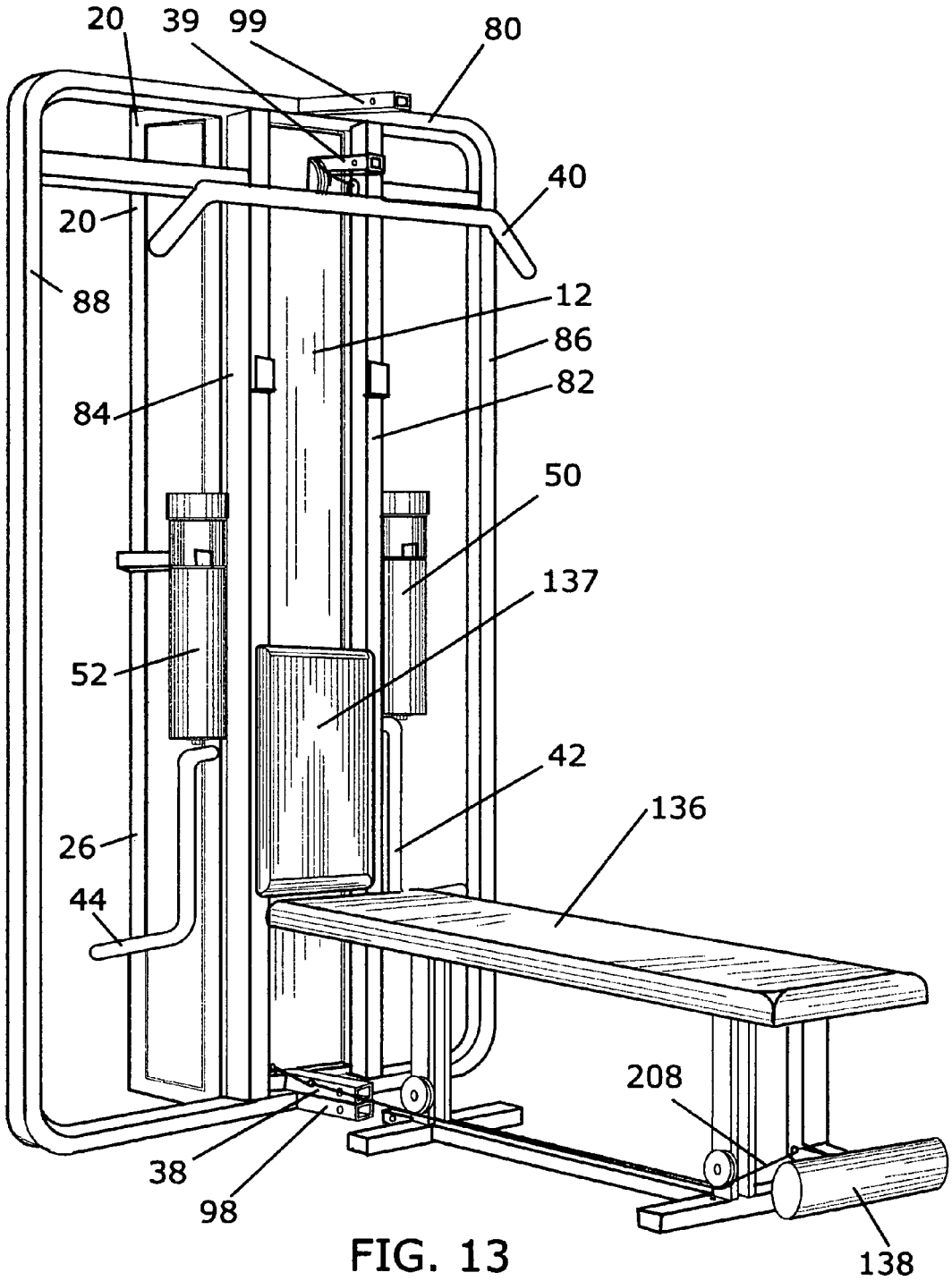
FIG. 13 illustrates a front perspective elevation view of an apparatus according to an embodiment of the invention.
Figure 14:
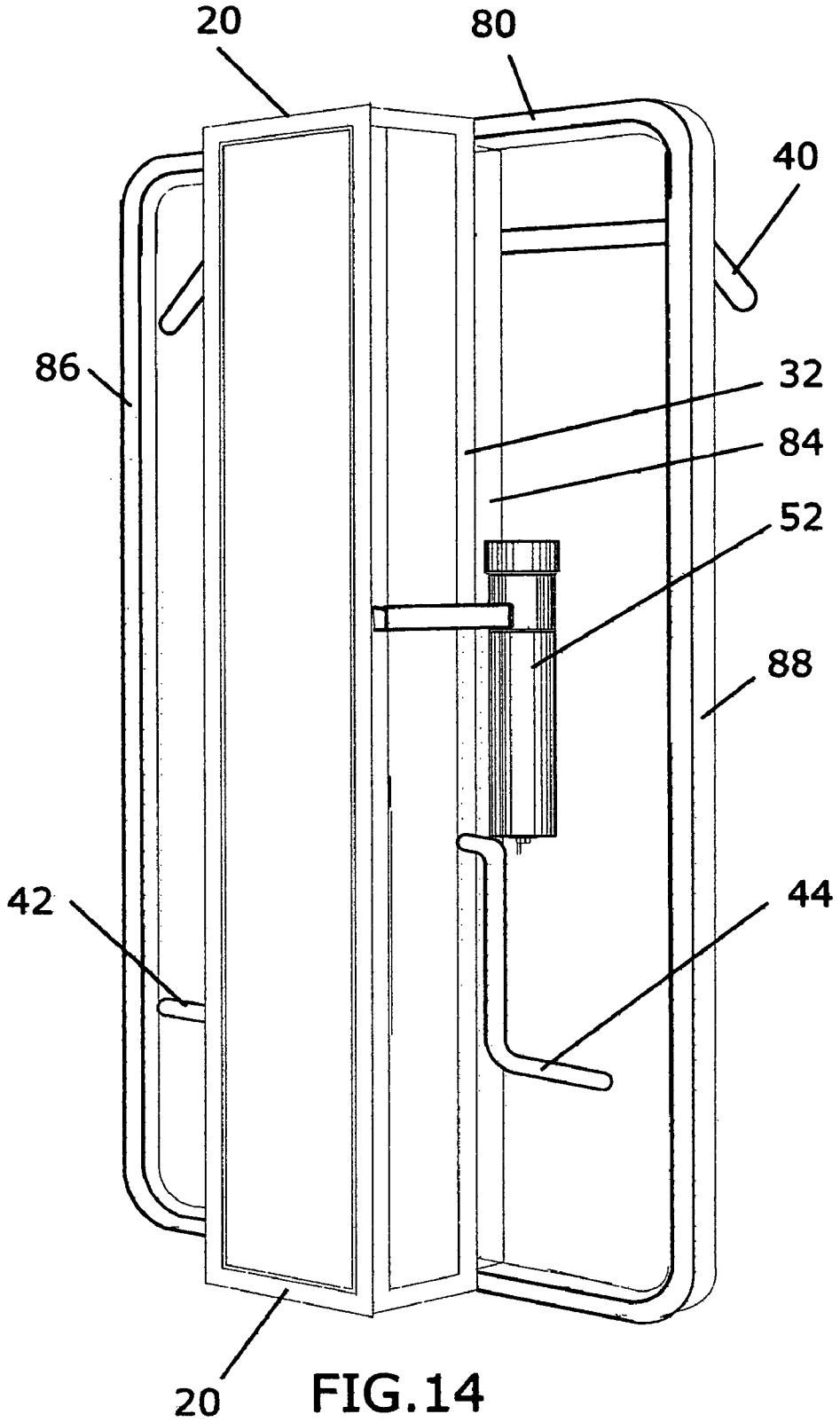
FIG. 14 illustrates a back perspective elevation view of an apparatus according to an embodiment of the invention.
Figure 15:
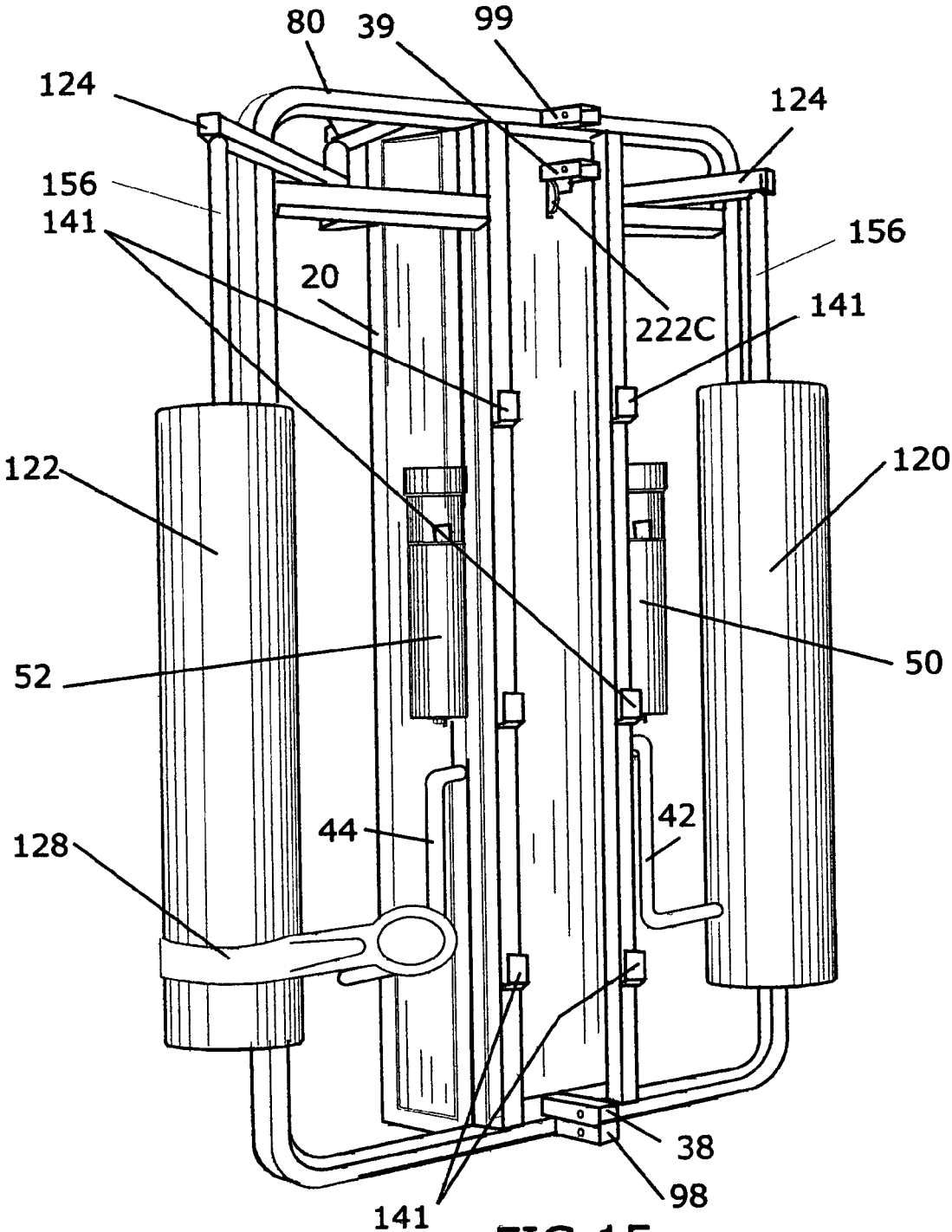
FIG. 15 illustrates a front perspective elevation view of an apparatus according to an embodiment of the invention.
Figure 16:
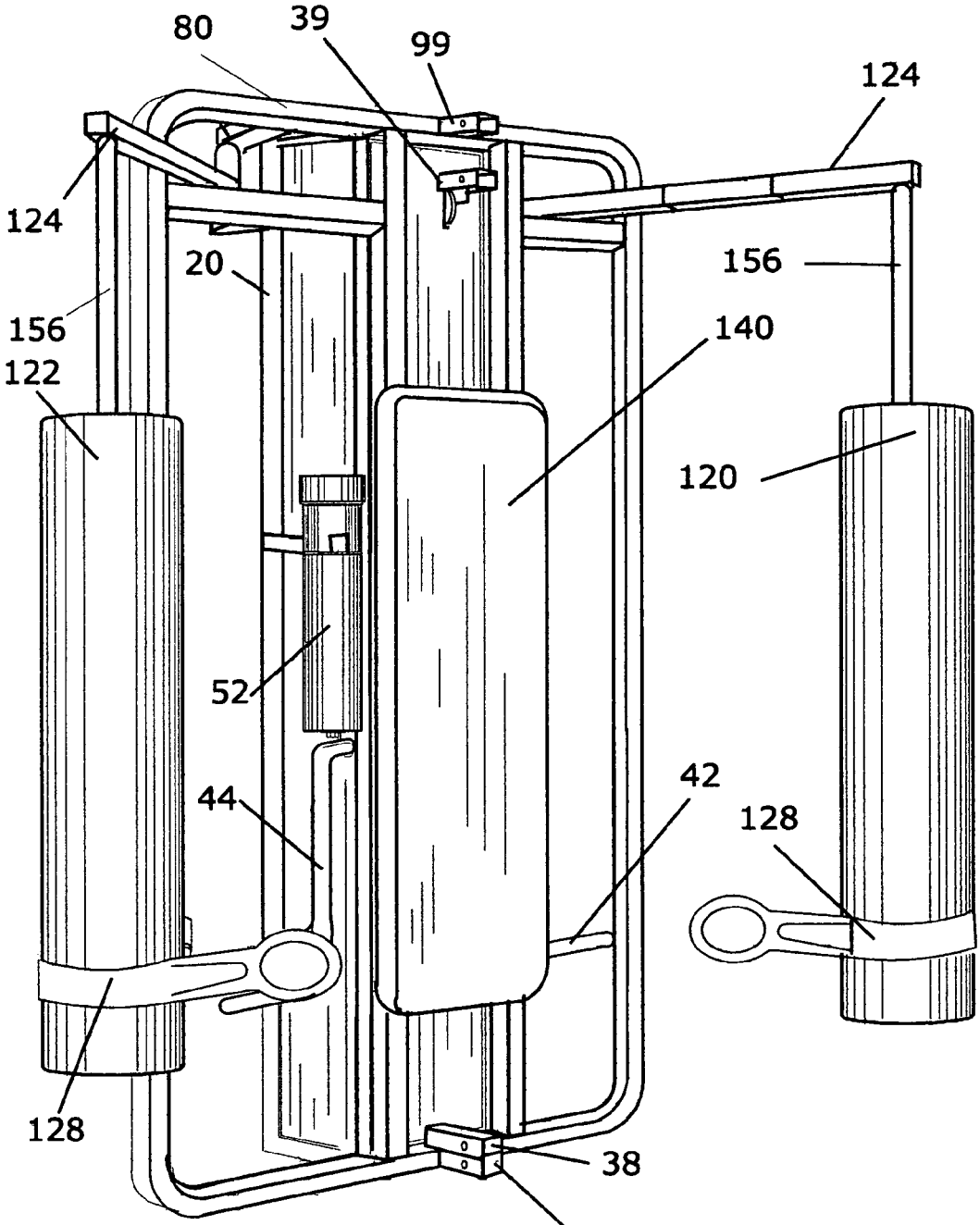
FIG. 16 illustrates a front perspective elevation view of an apparatus with a kick arm element in an extended position according to an embodiment of the invention.
Figure 17:
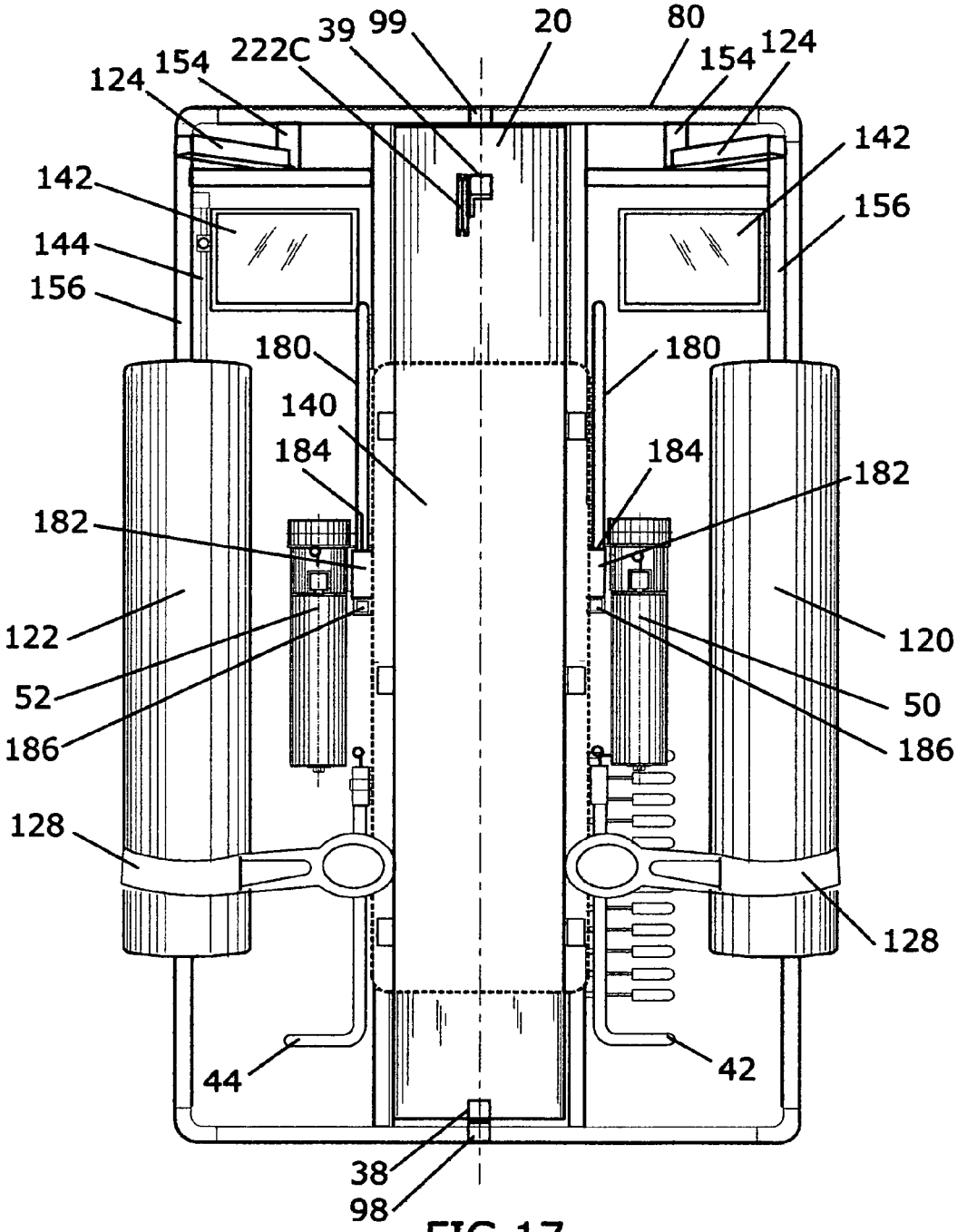
FIG. 17 illustrates a front elevation view of an apparatus according to an embodiment of the invention.
Figure 18:
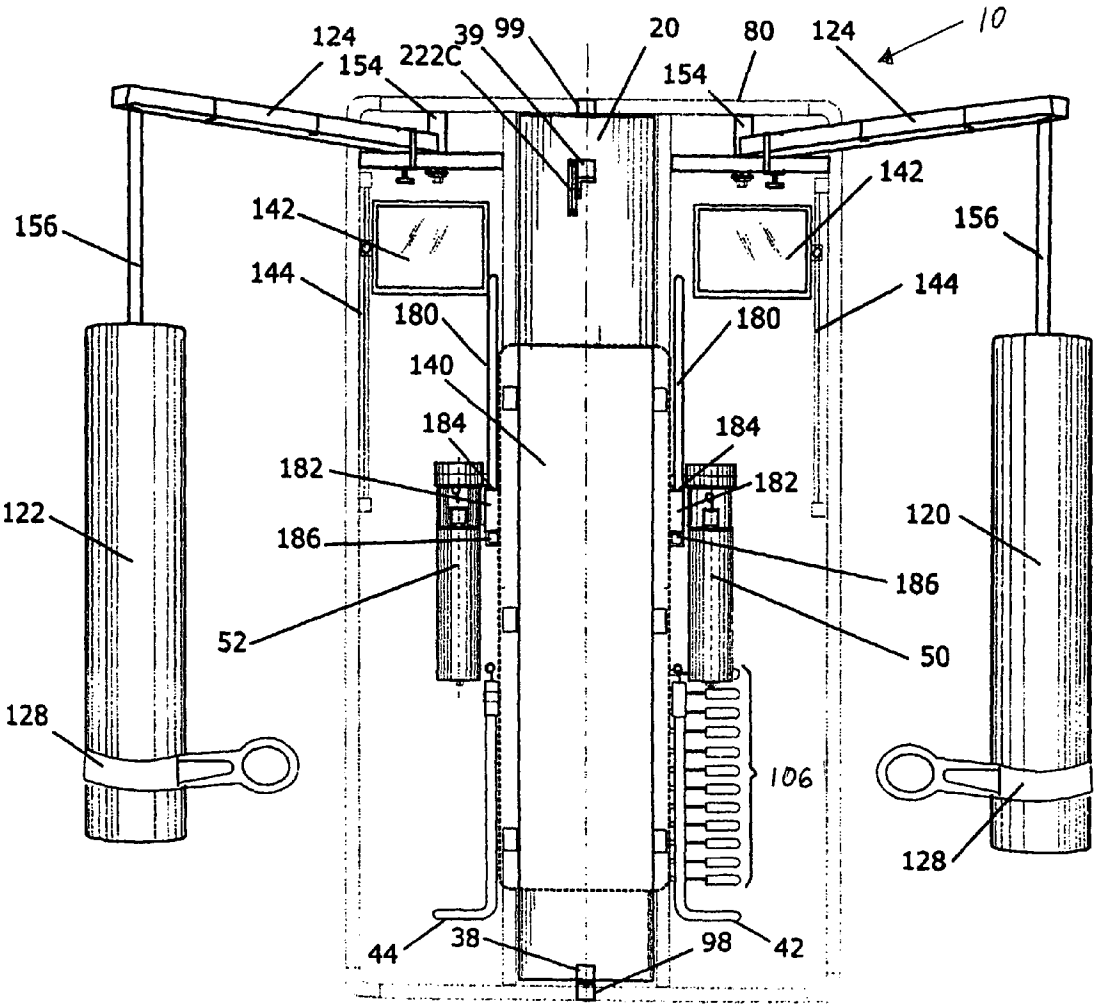
FIG. 18 illustrates a front elevation view of the apparatus with kick arm elements extended according to an embodiment of the invention.
Figure 19:
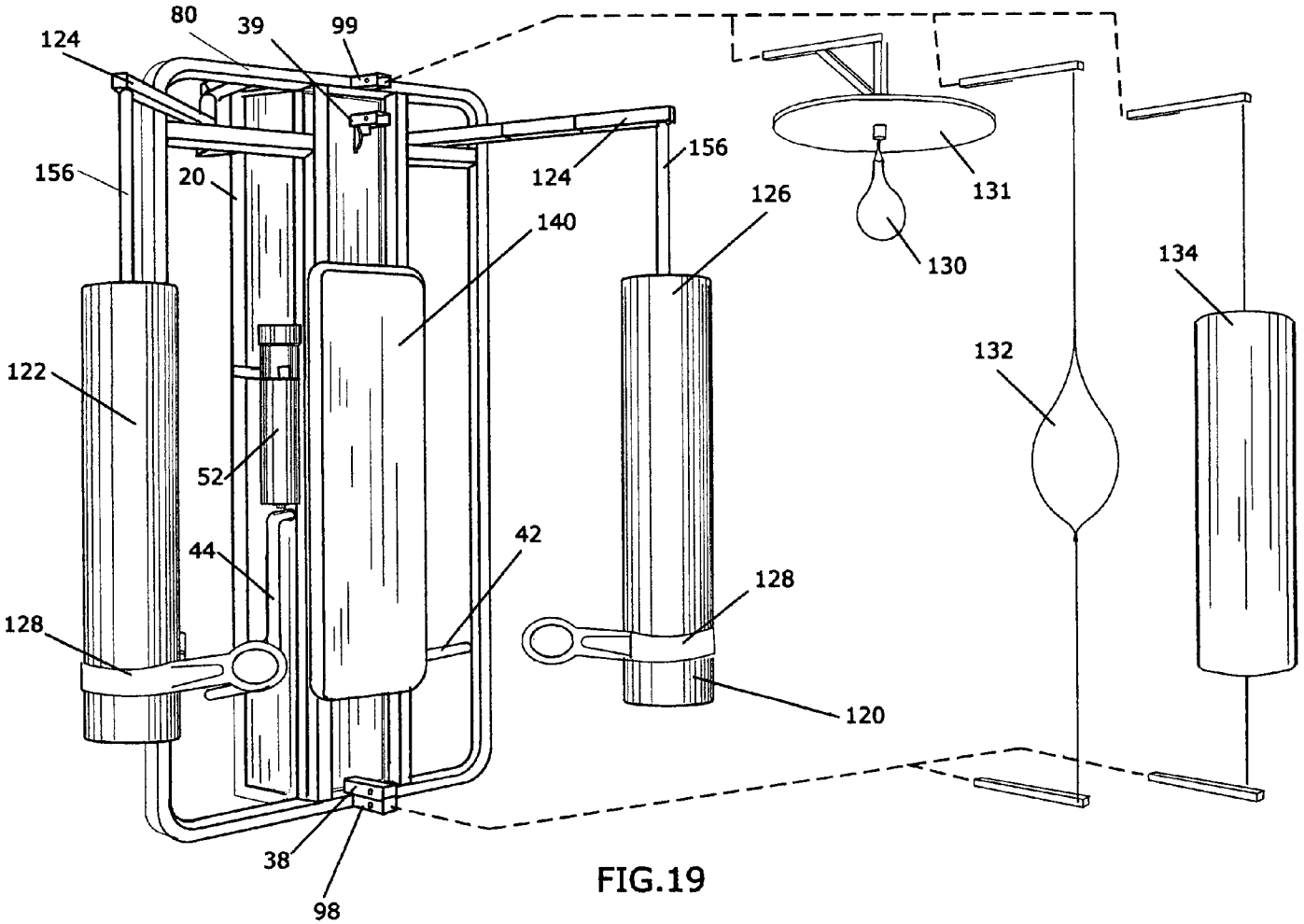
FIG. 19 illustrates a front perspective elevation view of an apparatus with optional exercise elements according to an embodiment of the invention.
Figure 20:
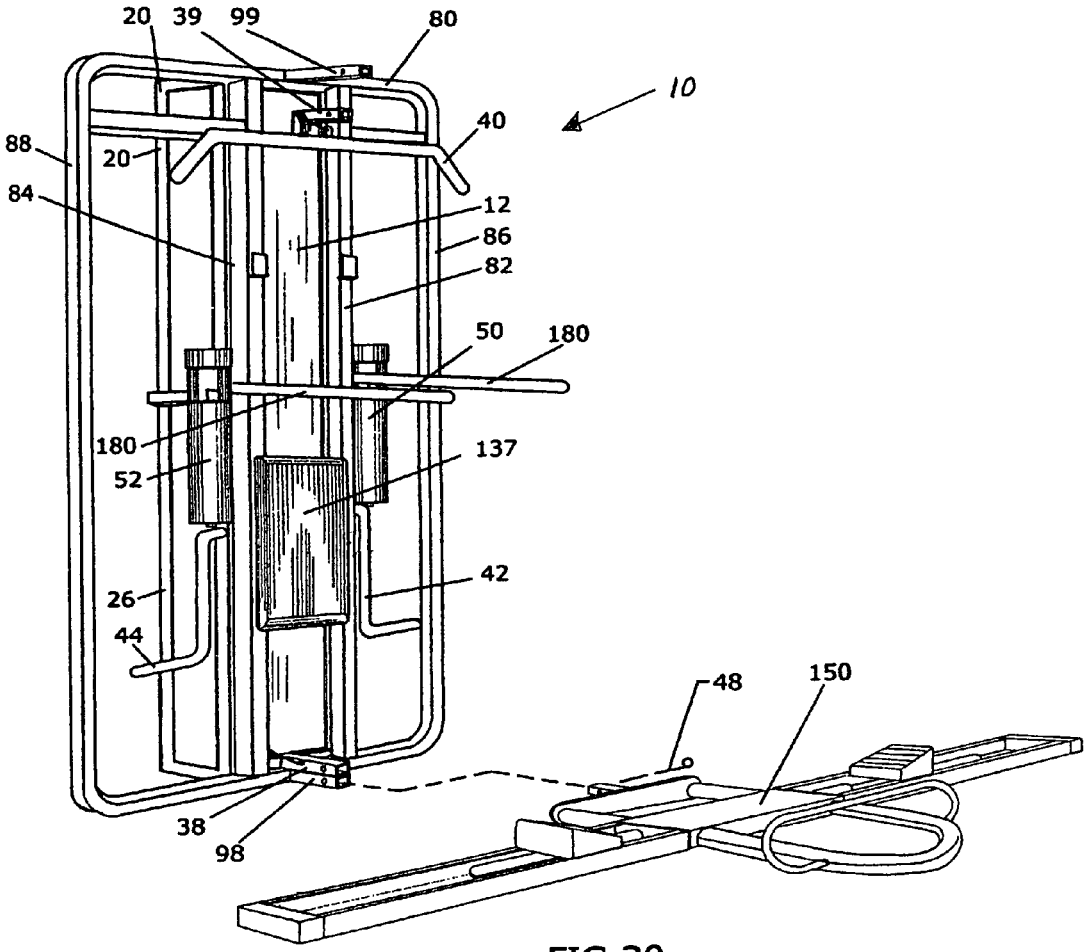
FIG. 20 illustrates a front perspective elevation view of an apparatus according to an embodiment of the invention.
Figure 21:
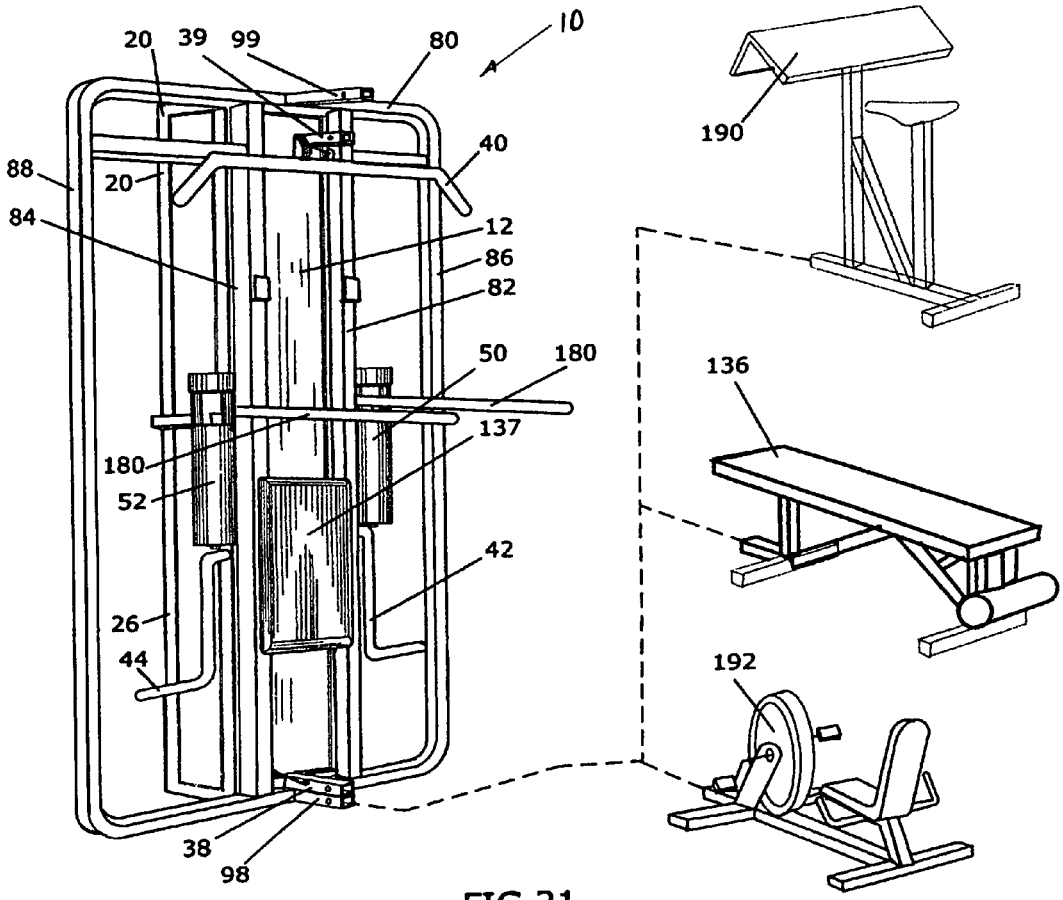
FIG. 21 illustrates a front perspective elevation view of an apparatus with perspective view of optional exercise apparatus according to an embodiment of the invention.
Figure 24:
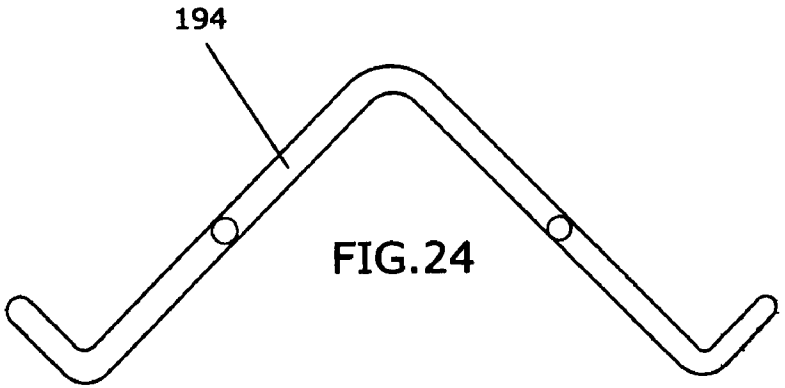
FIG. 24 illustrates a front view of a pull-up bar according to an embodiment of the invention.
Figure 25:
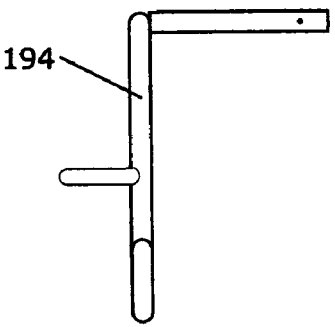
FIG. 25 illustrates a side view of a pull-up bar according to an embodiment of the invention.
Figure 26:
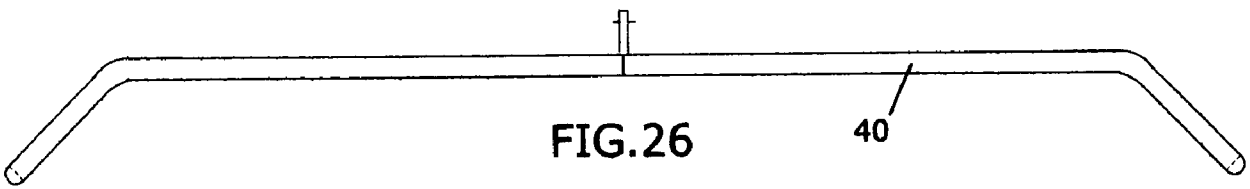
FIG. 26 illustrates a front elevation view of a horizontal bar according to an embodiment of the invention.
Figure 22:
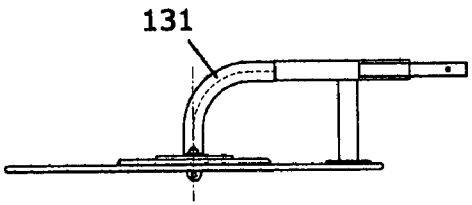
FIG. 22 illustrates a side view of a speed bag support according to an embodiment of the invention.
Figure 23:
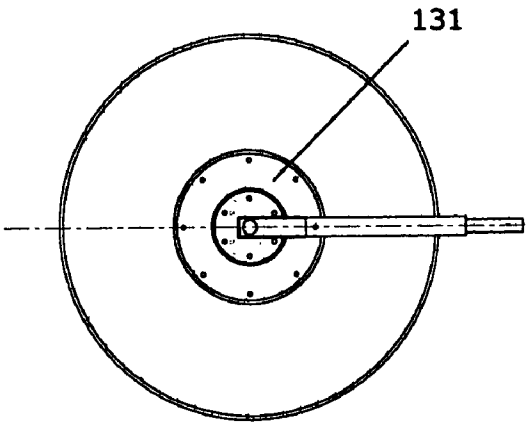
FIG. 23 illustrates a top view of a speed bag support according to an embodiment of the invention.

Referring to FIGS. 1 and 2, the exercise and workout apparatus with Karate elements 10 may have a central vertical structure 20 that may have an upper frame element 22, a lower frame element 24 and four upright frame members 26 attached at the corners 28 of the frame elements 22, 24 to generally form an open rectangular box shape. The frame elements 22, 24 and upright frame members 26 may be of tubular rectangular cross section form. The central vertical structure 20 may have panels or covers 14 to enclose the rectangular box that may be sheet metal, plastic or other suitable material.

The central vertical structure 20 may have a weight apparatus 100 for attachment of weight elements 102 to various exercise elements of the exercise apparatus 10. There may be a horizontal bar 40 attached to a cable 202. There may be support brackets 41 attached to front frame members 30, 32 for storing the bar 40. Weight elements 102 may be attachable to cable 202 and the cable 202 may be routed on pulleys 222 to allow exercise with the horizontal bar 40 by pulling downwardly on the bar.

There may be a right and left press bar 42, 44 attached by for example a pin 48 to a rotatable press shaft 46 rotatably attached to the central vertical structure 20. The rotatably shaft 46 may have pulleys 224 engage with cables 204 that may be attached to weight elements 102 to resist rotation of press shaft 46. This may allow a user to exert an upward force on the press bars 42, 44 to exercise, for example, in a manner similar to bench pressing weights for exercise.

A right and left pec element 50, 52 may be attached to right and left front frame members 30, 32 in position for rotation by a user about a pivot assembly 54. The pivot assembly 54 may be attached to a support plate 56 that may be attached to frame members 30, 32. The pivot assembly 54 may have a pulley attached to a cable 206 that may be routed over pulleys for attachment to weight elements 102 to resist rotation of the pivot assembly 54. This may allow a user to apply force against the pec elements 50, 52 to exercise. The pec elements 50, 52 may be attached to pec extension arms 66 that are slidably positioned in slots 64 of arm supports 62 for slidable extension outwardly from pivot assemblies 54 to adjust the leverage available for exercise.

There may be a lower pull cable 208 extending outwardly adjacent the lower frame member 24. The cable 208 may be routed over pulleys for attachment to weight elements 102 to resist an outward pull force on the cable 208. The cable 208 may be used for attachment to a variety of exercise devices, for example, a leg exercise device that may be an element of an exercise bench that may be attached to the attachment shaft 38.

Referring to FIGS. 1 through 6, to route cables to position the ends for attachments to exercise apparatus 10 elements there may be an upper pulley assembly 110 attached to the upper portion 34 of the central vertical structure 20 and a lower pulley assembly 112 attached to the lower portion 36 of the central vertical structure 20. Vertical weight guide rods 114 may be attached by collars 118 with set screws between the upper pulley assembly 110 and lower pulley assembly 112 to guide weight elements 102 when they may be lifted vertically during and exercise. There may be a weight select rod 104 that may be centrally disposed through multiple weight elements 102 and each weight element 102 may have a select rod attachment element 106 for attachment to the weight select rod 104. Selection of a particular weight element 102 may cause that weight element and all those weight elements positioned above it to be lifted by the weight select rod 104 during an exercise. The weight select rod 104 may be attached at a rod top 103 end to a cable 200 that may extend upwardly to be routed over a pulley 220A in upper pulley assembly 110 and then the cable 200 may extend downwardly to be attached to a weight select element 108. The weight select element 108 may be movable vertically by various cables to be pulled downwardly by a force on one or more cables to lift one or more of the weight elements 102 to perform an exercise. The cable 200 may also extend downwardly below the weight select element 108 to be routed over pulley 220B to then be routed upwardly to be attached to the rod bottom 105 end. This may aid in reducing slack in the cable 200 when operation the weight apparatus 100.

The pulley assemblies 110 and 112 may have a frame with shafts attached for support of the pulleys, The pulleys may have ball bearing central elements for ease of rotation on the shafts as may be known in the art or may have other rotational low friction interfaces.

The cable 202 for the horizontal bar 40 may be attached to the upper frame element 22 by a tension spring 250. The cable 202 may then extend downwardly to be routed over pulleys 222A and 222B in lower pulley assembly 112. The cable 202 may then extend upwardly to be routed over pulley 222C for attachment to the horizontal bar 40. The weight select element 108 may have a clamp 116 positioned to selectively clamp the cable 202 for engagement with the weight select element 108. When the clamp 116 may be engaged, a pull force on cable 202 during an exercise, for example with the horizontal bar 40, may cause the weight select element 108 to move downwardly and cause cable 200 to move selected weight elements 102 upwardly.

Two cables 204 for the press bars 42, 44 may be attached to the upper frame element 22 by a tension spring 250. The cables 204 may then extend downwardly to be routed over pulleys 224A in lower pulley assembly 112. The cables 204 may then extend upwardly and forwardly to be attached to pulleys 224B. The pulleys 224B may be fixedly attached to rotatable press shaft 46 such that if an upward force may be applied to a press bars 42, 44 the pulleys 224B may be rotated and apply a pulling force on the cables 204. If the cables 204 may be clamped by clamps 116 to the weight select element 108, selected weight elements 102 may be moved upwardly.

Two cables 206 for the pec elements 50, 52 may be attached to the upper frame element 22 by a tension spring 250. The cables 206 may then extend downwardly to be routed over pulleys 226A and 226B in lower pulley assembly 112. The cables 206 may then extend upwardly to be routed over pulleys 226C to then be attached to pulleys 226D. The pulleys 226C may be rotatably attached to a support plate 70 wherein the pulleys 226C may have ball bearing central elements. The pulleys 226D may be attached in a pivot assembly 54 that may be attached to the support plate 56. When the peck extension arm 66 may have a force applied, the pulley 226D may be rotated to apply a pulling force on the cables 206. If the cables 206 may be clamped by clamps 116 to the weight select element 108, selected weight elements 102 may be moved upwardly.

The cables 206 may also be routed through an idler pulley assembly 70 disposed between pulleys 226B and 226C. The idler pulley assembly 70 may have upper and lower fixed pulleys 72 and an intermediate pulley 74 biased by a spring 76. The spring-biased pulley 74 on an intermediate pulley arm 78 may apply force to the cables 206 to prevent slack in the cables.

The cable 208 for use adjacent the lower frame element 24 may be attached to the upper frame element 22 by a tension spring 250. The cable 208 may extend downwardly to be routed over pulleys 228A and 228B in lower pulley assembly 112 to extend outwardly adjacent the lower frame element 24. If the cable 208 may be clamped by a clamp 116 to the weight select element 108, and outward pulling force on the end of cable 208 may move selected weight elements 102 upwardly.

The weight select element 108 may be a generally rectangular flat plate shape having a pair of rollers 160 attached at each side edge 162. The rollers 160 may be positioned in a track 164 that may be a U-channel attached to the upper and lower frame elements 22, 24. The cable 200 may be clamped to the weight select element 108 approximately centered horizontally and there may be stabilizing cables 168 attached to cable 200 and to the top and bottom of the weight select element 108. The clamps 116 attached to the weight select element 108 may have a link 170 to a selection lever 172 for each cable combination that may be selectable for use of the apparatus for exercise.

The pec exercise pivot assembly 54 may have pulley 226D attached to a peck pulley lever bracket 58. The pulley 226D and bracket 58 may be attached to an arm support 62 such that rotation of the arm support 62 will rotate pulley 226D. There may be a spacer element 68 attached to a pivot bracket 57 to position the arm support 62 relative to the pivot bracket 57. The pivot bracket 57 may be attached to the support plate 56. The attachment of the pulley 226D, bracket 58 and arm support 62 may be by a bolt and nut. There may be a top cover 55 on the pivot assembly 54. The pec elements 50, 52 may be attached to the pec shaft 60 by a screw.

Referring to FIGS. 7 through 12, there may be a support frame 80 that may have interior generally vertical frame members 82, 84 spaced apart and may have side frame members 86, 88 spaced apart from the vertical frame members 82, 84 and the frame members 82, 84, 86, 88 may be attached to an upper cross member 90 and a lower cross member 92. The support frame 80 may have a right side attachment element 81 threadably engaged in a threaded aperture near the upper right corner 89 and a left side attachment element 83 threadably engaged in a threaded aperture near the upper left corner 91. The attachment elements 81, 83 may be rotated to extend upwardly to engage an overhead structure, for example, a building ceiling, an overhead beam, an overhead frame or the like, to maintain the support frame 80 in position for use by a user 300.

There may be a right and left kick frame element and bracket 94, 96 attached to the side frame members 86, 88 and lower cross member 92 for attachment of a right and left kick arm element 120, 122. The kick arm elements 120, 122 may be rotatably attached to the kick brackets 94, 96 and may have an extension arm 124 and a kick pad 126 that may be generally cylindrical in shape. The kick pad 126 may have a kick target 128 attached by a hook and loop strap 129 or other attachment that may protrude outwardly from the kick pad 126.

The right and left kick arm elements 120, 122 may also be rotatably attached to the support frame 80 adjacent upper cross member 90. A kick arm cross member 152 may be attached between each side member 86, 88 and each vertical frame member 82, 84. A swing arm bracket 154 may be attached to protrude rearwardly from the support frame 80 for pivotal attachment of a first end of the extension arm 124. The extension arm 124 may be positioned to rest on the kick arm cross member 152 when the swing arm bracket 154 protrudes sufficiently rearwardly for the structure to support the kick arm element 120 or 112. The extension arm 124 may be positioned by attachment of a C-clamp, a pin placed in apertures or other like attachment to retain the extension arm 124 relative to the kick arm cross member 152. The extension arm 124 may be a telescoping arm that may be attached at a second end to a central shaft 156 having the kick pad attached.

The central vertical element structure 20 may have an attachment shaft 38 protruding forwardly from the front 12 and centrally positioned at the lower frame element 24; and an elevation attachment shaft 39 protruding forwardly from the front 12 and centrally positioned adjacent the upper frame element 22. The support frame 80 may have a lower attachment shaft 98 and an upper attachment shaft 99 protruding forwardly from the front 12 and centrally positioned at the upper and lower cross members 90, 92. The central vertical structure 20 may have right and left front frame members 30, 32 attachable to interior frame members 82, 84 that may be spaced apart to mate with the frame members 30, 32.

Referring to FIGS. 13 through 26, the elevation attachment shaft 39 may have a pulley 222C with cable 202 routed from the weight elements 102 to the horizontal bar 40. Other exercise elements such as a boxing ball element 130 or speed bag, a tethered ball element 132 and a boxing bag 134 may be attached at attachment shafts 38, 98, 99. An exercise bench 136 may be attached to lower attachment shaft 98. The exercise bench 136 may have a back support 137 and a leg exercise device 138. The leg exercise device 138 may be a pivot type device and the cable 208 may be attached for selection of weight elements to present a pulling force for leg exercises.

There may be a pair of support arms 180 movably attached to the central vertical structure 20. The support arms 180 may be inserted in a retainer 182 having a vertical oriented aperture 184 and a horizontal aperture 186. In the vertical oriented aperture 184 the support arms may be adjacent frame members 82, 84 as best viewed in FIG. 17 or 18. In the horizontal oriented apertures 186 the support arms may extend outwardly from the front as best viewed in FIG. 20 or 21. The support arms 180 may be used for balancing when doing certain exercises.

A kick board 140 that may be padded and may have springs, may be attached to the vertical frame members 82, 84 by clips 141.

A track assembly 150 may be attached to the lower attachment shaft 98 by a pin 48. The support arms 180 may be used for balancing when exercising on the track assembly 150.

Other devices such as an arm rest weight device 190, a cycling device 192 and the like may be attached to the apparatus 10. Also devices may be structured for insertion in the elevation attachment shaft 39 and upper attachment shaft 99. A speed bag 130 support 131 may be inserted and attached in shaft 99. A pull-up bar 194 that may have two holding positions may be inserted and attached in 99.

Figure 27:
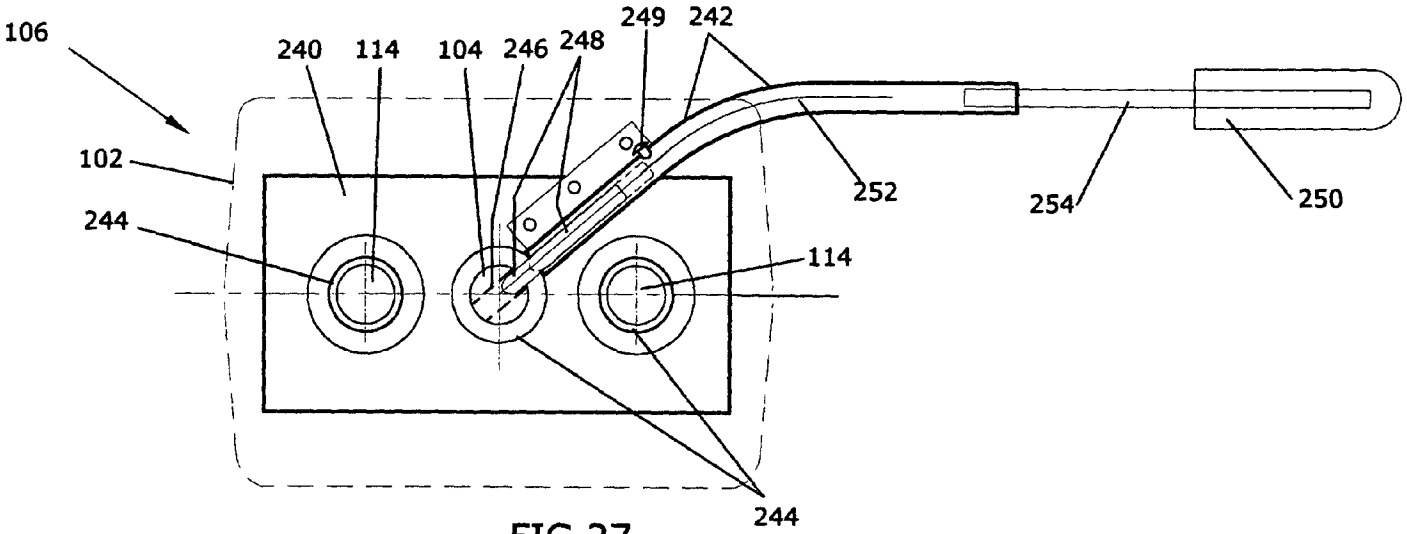
FIG. 27 illustrates a top view of a weight selection device according to an embodiment of the invention.
Figure 27A:
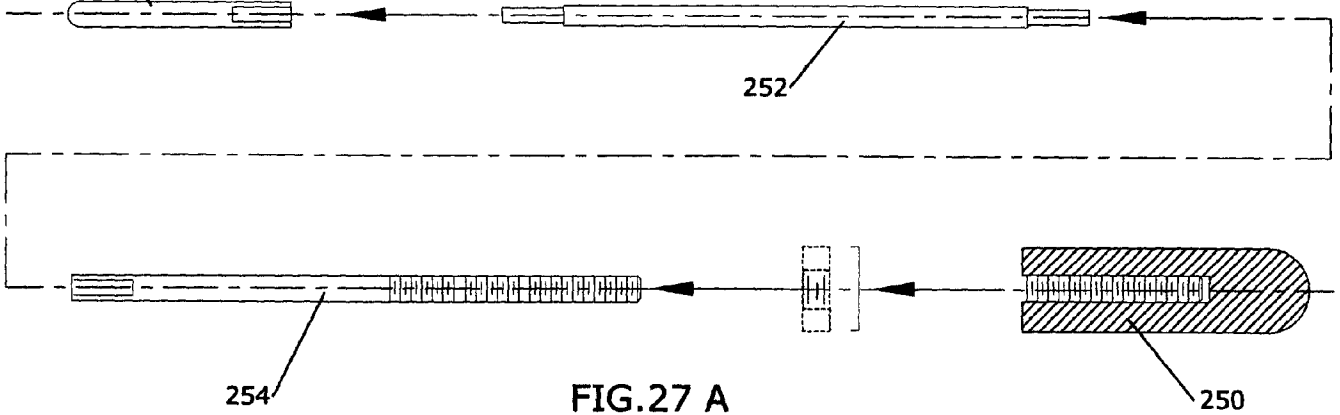
FIG. 27A illustrates an exploded view of a weight selection device according to an embodiment of the invention.

Referring to FIGS. 27 and 27A, the select rod attachment element 106 may have a plate 240 with a clip and guide tube 242 attached. The plate 240 may have apertures 244 for receipt of vertical weight guides 114 and weight selection rod 104. The weight selection rod 104 may have selection apertures 246 for receipt of a select pin 248. The select pin 248 may be attached to a selection handle 250 by a flexible cable 252 and an attachment rod 254 disposed in guide tube 242.

Monitors 142 may be attached at for example the upper portion of the side frame members 86, 88. The monitors 142 may be positioned for a user to view during exercise activity. They may be tape or DVD player devices, televisions or other display type. They may be attached to an adjustment bracket 144.

Figure 28:
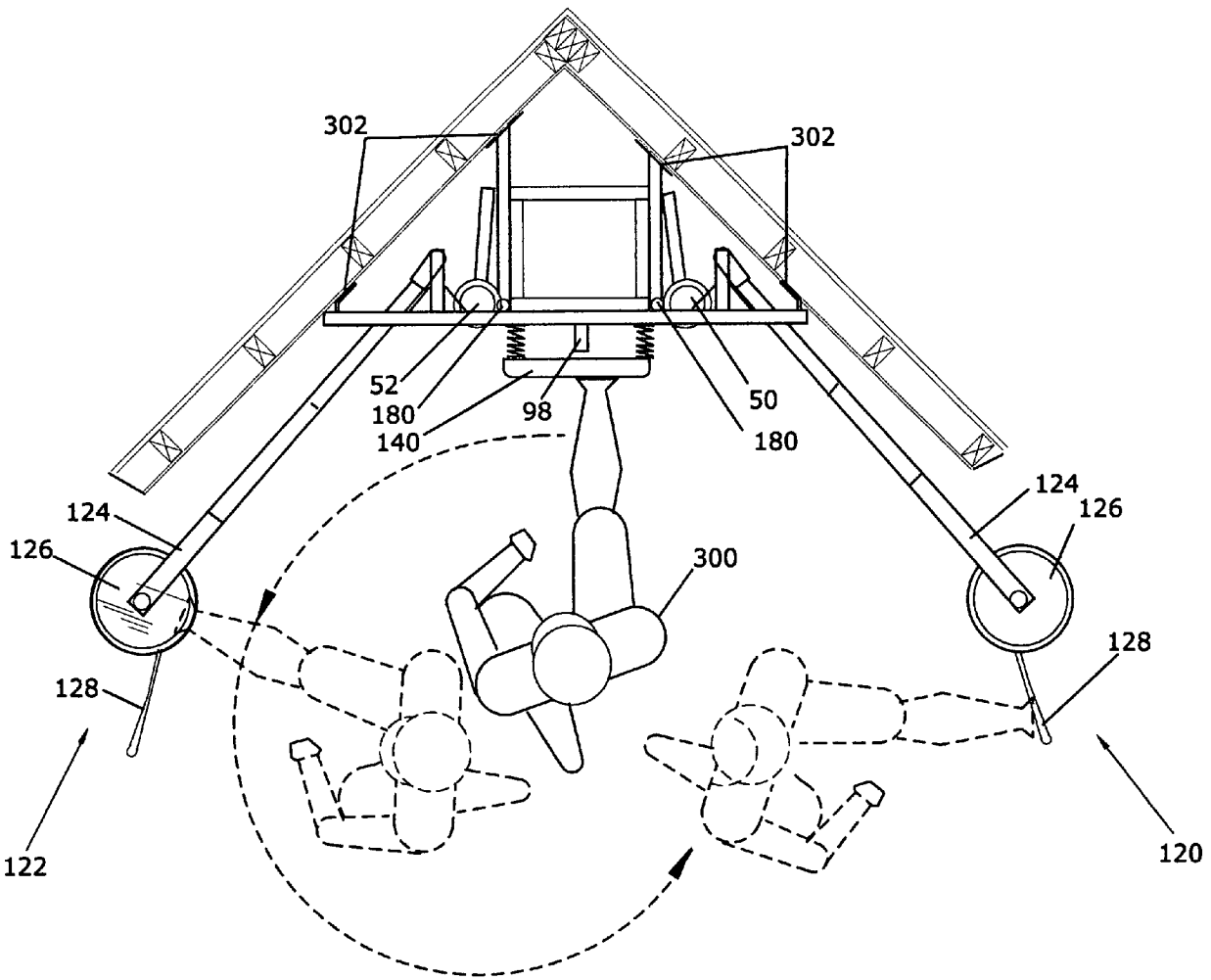
FIG. 28 illustrates a top view of an apparatus according to an embodiment of the invention.
Figure 29:
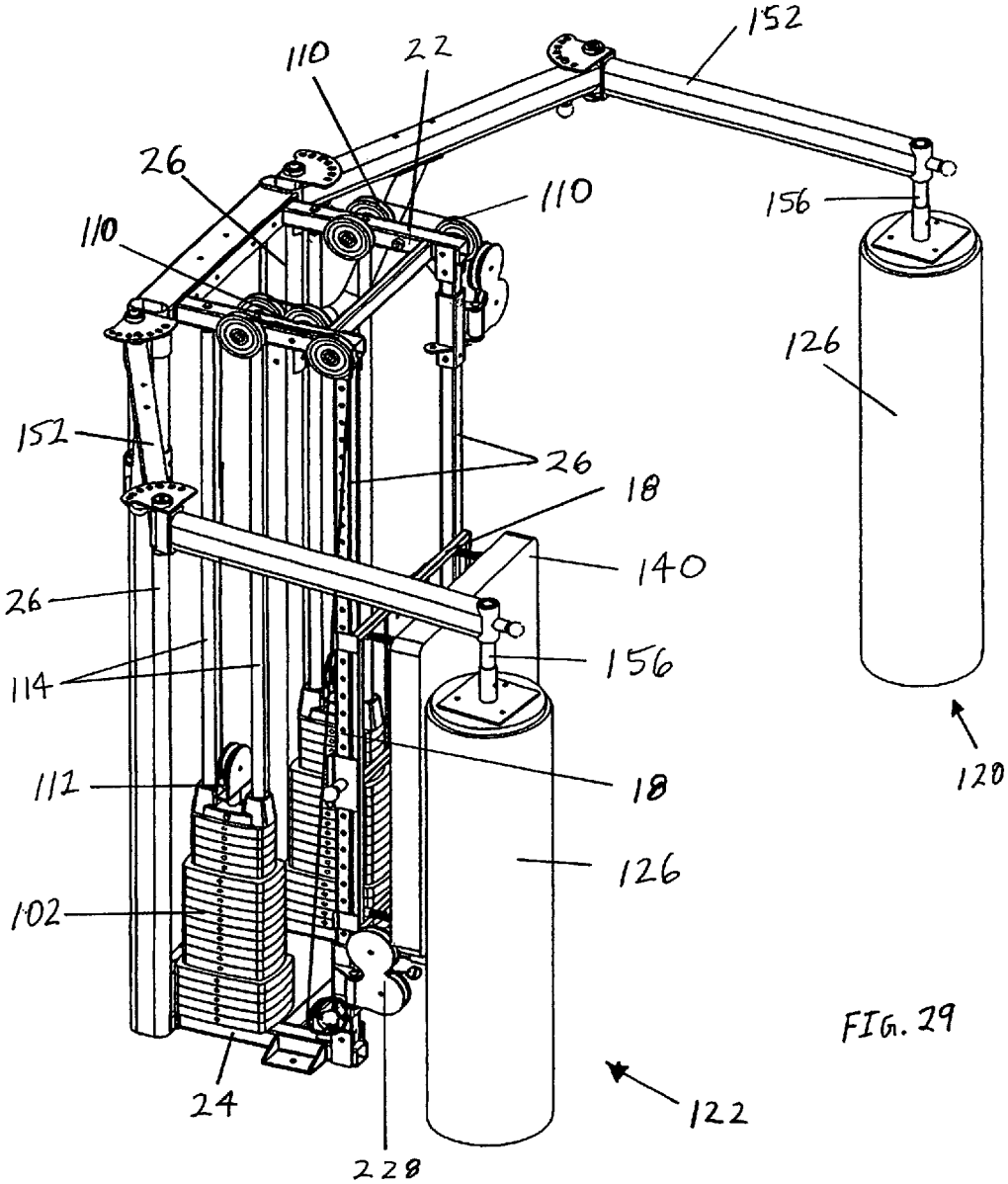
FIG. 29 illustrates a perspective elevation view of a central vertical structure according to an embodiment of the invention.

Referring to FIG. 28, an example of an apparatus 10 attached to a corner in a room or structure is illustrated. A user 300 may alternately exercise kicking in a rotating manner the targets presented by the apparatus 10. Various bracket elements 302 may be used to adapt for attachment to a particular vertical structure.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for human exercise comprising:

a support frame having two interior frame members spaced apart and disposed generally vertical with two side frame members spaced apart from and generally parallel to said two interior frame members;

an upper cross member attached at an upper end and a lower cross member attached at a lower end of said two interior frame members and said two side frame members;

a right kick arm element and a left kick arm element rotatably attached for horizontal positioning to said support frame;

a kick board attached to said two interior frame members;

a right kick arm cross member and a left kick arm cross member are attached respectively between one of each interior frame members and one of each side frame members adjacent to said upper cross member;

a right swing arm bracket and a left swing arm bracket are attached to said upper cross member and respectively to said right kick arm cross member and said left kick arm cross member, and disposed rearwardly for rotatable attachment of a first end of respective extension arms of said right kick arm element and said left kick arm element;

each of said extension arms is disposed respectively on said right kick arm cross member and said left kick arm cross member; and each of said extension arms having attached at a second end a central shaft extending downwardly and having a kick pad attached thereto.

2. The apparatus as in claim 1 wherein a kick target is attached to the kick pad of each of said right kick arm element and said left kick arm element.

3. The apparatus as in claim 1 wherein said extension arm is slidably disposed on said kick arm cross member and retained in a position by attachment of a clamp.

4. The apparatus as in claim 1 wherein each of said extension arm is a telescoping extension arm.

5. The apparatus as in claim 1 wherein said kick board having a plurality of pad springs disposed and attached to a rear side for attachment to said two interior frame members.

6. The apparatus as in claim 5 wherein said two interior frame members having a plurality of clips attached and disposed for engagement of said pad springs.

7. The apparatus as in claim 1 wherein a right kick frame element and bracket and a left kick frame element and bracket are attached respectively to a right side member and said lower cross member and to a left side member and said lower cross member disposed for rotatable attachment of a first end of an extension arm.

8. The apparatus as in claim 1 wherein said support frame having a right side attachment element adjacent an upper right corner and a left side attachment element adjacent an upper left corner.

9. The apparatus as in claim 8 wherein said right side attachment element and said left side attachment element are threadably engaged in said upper cross member.

10. The apparatus as in claim 1 wherein said upper cross member having an upper attachment shaft.

11. The apparatus as in claim 1 wherein said lower cross member having a lower attachment shaft.

12. The apparatus as in claim 1 further comprising:

a central vertical structure having an upper frame element and a lower frame element with four upright frame members attached therebetween to form a generally open rectangular box frame;

an upper pulley assembly attached to an upper portion of said central vertical structure and a lower pulley assembly attached to a weight apparatus;

said weight apparatus having a plurality of weight elements disposed in said central vertical structure;

a weight select rod disposed centrally in each of said weight elements and each weight element having a select rod attachment element for attachment to said weight select rod;

a first cable attached to said weight select rod and routed over a first pulley in said upper pulley assembly to be attached to a weight select element wherein said weight select element is movable vertically in said central vertical structure;

a second cable attached to said upper frame element by a first tension spring and extended downwardly to be routed over a second pulley and a third pulley in said lower pulley assembly, and then extended upwardly to be routed over a fourth pulley rotatably attached to an elevated attachment shaft wherein said second cable is releasably attachable to said weight select element;

a third cable and a fourth cable each attached to said upper frame element by a tension spring and extending downwardly, said third cable routed over a fifth pulley in said lower pulley assembly and attached to a sixth pulley, and said fourth cable routed over a seventh pulley in said lower pulley assembly and attached to an eighth pulley wherein said third cable and said fourth cable are each releasably attachable to said weight select element;

said sixth pulley and said eighth pulley fixedly attached to a press shaft rotatably attached to said central vertical structure intermediate said upper portion and said lower portion and said press shaft having a press bar attached at each end;

a fifth cable and a sixth cable each attached to said upper frame element by a tension spring and extending downwardly, said fifth cable routed over a ninth pulley and a tenth pulley in said lower cable assembly then extended upwardly and routed over an eleventh pulley to be attached to a twelfth pulley, and said sixth cable routed over a thirteenth pulley and a fourteenth pulley in said lower pulley assembly then extended upwardly and routed over a fifteenth pulley to be attached to a sixteenth pulley wherein said fifth cable and said sixth cable are each releasably attachable to said weight select element;

said twelfth pulley and said sixteenth pulley each attached in a respective pivot assembly wherein each of said pivot assemblies are rotatably attached to a support plate disposed and attached to said central vertical structure intermediate said upper portion and said lower portion, and each of said pivot assemblies having a pec element attached; and a right front frame member and a left front frame member attached to each one of said two interior frame members.

13. The apparatus as in claim 12 wherein a horizontal bar is attached to a free end of said second cable.

14. The apparatus as in claim 13 wherein there is a support bracket attached to a right front frame member and a left front frame member disposed for storage of said horizontal bar.

15. The apparatus as in claim 12 wherein said releasable attachment of a plurality of cables is a plurality of clamps disposed and attached on said weight select element wherein when a cable is clamped a force exerted on said cable will move said weight select element downwardly and a selected weight element upwardly.

16. The apparatus as in claim 12 wherein said fifth cable and said sixth cable are routed through an idler pulley assembly disposed between said lower pulley assembly and said support plate.

17. The apparatus as in claim 16 wherein said idler pulley assembly comprises an upper fixed pulley, a lower fixed pulley and an intermediate pulley disposed between said upper fixed pulley and said lower fixed pulley and biased by a spring.

18. The apparatus as in claim 12 wherein a seventh cable is attached to said upper frame element by a tension spring and extends downwardly to be routed over a seventeenth pulley and an eighteenth pulley in said lower pulley assembly to extend outwardly adjacent said lower frame element wherein said seventh cable is releasably attachable to said weight select element.

19. The apparatus as in claim 12 wherein said weight select element comprises:

a plate having a generally rectangular flat shape with a pair of rollers attached at each side edge;

each of said pair of rollers disposed in a track attached to said upper frame element and said lower frame element;

said first cable attached to said plate approximately horizontally centered; and a plurality of clamps disposed and attached on said plate.

20. The apparatus as in claim 19 wherein each of said plurality of clamps having a link connected to a selection lever.

21. The device as in claim 12 wherein said frame elements and said upright frame members are of tubular rectangular cross section form.

22. The device as in claim 12 wherein said central vertical structure having four sides and a cover attached on each side.

23. The apparatus as in claim 12 wherein a vertical weight guide rod is attached to said upper pulley assembly and said lower pulley assembly, and said vertical weight guide rod is inserted through said weight elements having a rod aperture therein.

24. The apparatus as in claim 12 wherein each of said pivot assemblies further comprising:

said support plate having two pivot brackets for attachment of each of said pivot assemblies;

an arm support having a slot therein with a pec extension arm slidably disposed in said slot; and a pec shaft attached adjacent an end of said pec extension arm for attachment of said pec element disposed on said pec shaft.

* * * * *